US009282862B2

(12) United States Patent
Henderson et al.

(10) Patent No.: US 9,282,862 B2
(45) **Date of Patent: *Mar. 15, 2016**

(54) STEERING ASSEMBLY FOR SURFACE CLEANING DEVICE

(75) Inventors: Gregg A. Henderson, Munroe Falls, OH (US); Douglas M. Rukavina, Massillon, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 333 days.

This patent is subject to a terminal disclaimer.

(21) Appl. No.: 13/273,943

(22) Filed: Oct. 14, 2011

(65) Prior Publication Data

US 2013/0091652 A1 Apr. 18, 2013

(51) Int. Cl.

| | |
|---|---|
| ***A47L 9/32*** | (2006.01) |
| ***A47L 9/00*** | (2006.01) |
| ***A47L 5/28*** | (2006.01) |

(52) U.S. Cl.

CPC ..... *A47L 9/0054* (2013.01); *A47L 5/28* (2013.01); *A47L 9/009* (2013.01)

(58) Field of Classification Search

CPC ..... A47L 5/28; A47L 9/0054; A47L 9/009
USPC ..... 15/410, 411, 144.1, 144.2
See application file for complete search history.

(56) References Cited

U.S. PATENT DOCUMENTS

| | | | | |
|---|---|---|---|---|
| 377,860 | A | | 2/1888 | Menzenhauer |
| 1,086,367 | A | | 2/1914 | Hope |
| 1,953,944 | A | | 4/1934 | Becker |
| 2,038,697 | A | | 4/1936 | Winslow |
| 2,062,508 | A | | 12/1936 | Faber |
| 2,162,313 | A | | 6/1939 | McCabe et al. |
| 2,213,792 | A | | 9/1940 | Dow et al. |
| 2,246,438 | A | | 6/1941 | Hedlund |
| 2,300,266 | A | | 10/1942 | Smellie |
| 2,343,056 | A | | 2/1944 | Harlett |
| 2,464,587 | A | * | 3/1949 | Knight ..... 403/95 |
| 2,689,969 | A | | 9/1954 | Seck |
| 2,867,833 | A | | 1/1959 | Duff |

(Continued)

FOREIGN PATENT DOCUMENTS

| | | |
|---|---|---|
| DE | 10246672 | 4/2004 |
| DE | 202009017028 | 3/2010 |

(Continued)

OTHER PUBLICATIONS

International Search Report and Written Opinion for Application No. PCT/US2011/056392 dated Jul. 23, 2012 (10 pages).

(Continued)

*Primary Examiner* — Michael Jennings
(74) *Attorney, Agent, or Firm* — Michael Best & Friedrich LLP

(57) ABSTRACT

A surface cleaning device having a steering assembly is provided. The surface cleaning device includes a foot, a handle assembly with a user manipulated handle, and a steering assembly coupling the handle assembly to the foot. The steering assembly defines an open path between the handle assembly and the foot and includes a means for biasing the foot with respect to the handle assembly. Movement of the handle assembly stores energy within the biasing means so that the biasing means exerts a corresponding force on the foot.

30 Claims, 13 Drawing Sheets

(56) References Cited

U.S. PATENT DOCUMENTS

| | | | | |
|---|---|---|---|---|
| 2,974,347 | A | 3/1961 | Seyfried | |
| 2,980,939 | A * | 4/1961 | Sparklin et al. | 15/377 |
| 3,126,570 | A | 3/1964 | Green | |
| 3,205,528 | A | 9/1965 | Fromknecht et al. | |
| 3,226,758 | A | 1/1966 | Brown et al. | |
| 3,380,107 | A | 4/1968 | Ritzau et al. | |
| 3,581,591 | A | 6/1971 | Ziegler et al. | |
| 3,715,775 | A | 2/1973 | Nickelson | |
| 3,800,351 | A | 4/1974 | Fukuba | |
| 3,938,216 | A | 2/1976 | Schmitz et al. | |
| 4,171,553 | A | 10/1979 | Stein | |
| 4,268,769 | A | 5/1981 | Dorner et al. | |
| 4,307,485 | A * | 12/1981 | Dessig, III | 15/325 |
| 4,536,908 | A | 8/1985 | Raubenheimer | |
| 4,537,424 | A | 8/1985 | Maier et al. | |
| 4,564,972 | A | 1/1986 | Varin | |
| 4,724,574 | A | 2/1988 | Bowerman et al. | |
| 4,849,024 | A | 7/1989 | Supra | |
| 5,046,218 | A | 9/1991 | Cerri | |
| 5,323,510 | A | 6/1994 | Redding et al. | |
| 5,381,577 | A | 1/1995 | Lilja | |
| 5,414,889 | A * | 5/1995 | Sartori | 15/159.1 |
| 5,461,749 | A | 10/1995 | Ahlberg et al. | |
| 5,483,726 | A | 1/1996 | Blase et al. | |
| 5,537,710 | A | 7/1996 | Selewski et al. | |
| 5,553,349 | A | 9/1996 | Kilstrom et al. | |
| 5,584,095 | A | 12/1996 | Redding et al. | |
| 5,715,566 | A * | 2/1998 | Weaver et al. | 15/320 |
| 5,779,155 | A | 7/1998 | Schennum et al. | |
| 5,794,305 | A * | 8/1998 | Weger | 15/411 |
| 5,875,926 | A | 3/1999 | Schwartz | |
| 5,888,006 | A | 3/1999 | Ping et al. | |
| 5,960,508 | A | 10/1999 | Holt et al. | |
| 5,988,920 | A | 11/1999 | Kunkler et al. | |
| 6,003,191 | A | 12/1999 | Sherry et al. | |
| 6,045,622 | A | 4/2000 | Holt et al. | |
| 6,048,123 | A | 4/2000 | Holt et al. | |
| 6,055,703 | A * | 5/2000 | Redding et al. | 15/411 |
| D428,226 | S | 7/2000 | Kunkler | |
| 6,101,661 | A | 8/2000 | Policicchio et al. | |
| 6,119,293 | A | 9/2000 | Phillipson et al. | |
| 6,209,925 | B1 | 4/2001 | Edin | |
| 6,298,517 | B1 | 10/2001 | McKay | |
| 6,305,046 | B1 | 10/2001 | Kingry et al. | |
| 6,345,408 | B1 | 2/2002 | Nagai et al. | |
| 6,363,571 | B1 | 4/2002 | Block et al. | |
| 6,380,151 | B1 | 4/2002 | Masters et al. | |
| D458,427 | S | 6/2002 | Kunkler et al. | |
| D458,722 | S | 6/2002 | Romero et al. | |
| 6,401,294 | B2 | 6/2002 | Kasper | |
| 6,484,346 | B2 | 11/2002 | Kingry et al. | |
| 6,532,622 | B2 | 3/2003 | Seon et al. | |
| 6,550,092 | B1 | 4/2003 | Brown et al. | |
| 6,550,639 | B2 | 4/2003 | Brown et al. | |
| 6,551,001 | B2 | 4/2003 | Aberegg et al. | |
| 6,571,423 | B1 | 6/2003 | Lijzenga et al. | |
| 6,574,831 | B2 * | 6/2003 | Hunter et al. | 15/410 |
| 6,601,261 | B1 | 8/2003 | Holt et al. | |
| 6,643,894 | B1 | 11/2003 | Dell | |
| 6,695,352 | B2 | 2/2004 | Park et al. | |
| 6,742,220 | B2 | 6/2004 | Nagai et al. | |
| 6,775,882 | B2 | 8/2004 | Murphy et al. | |
| 6,779,229 | B2 | 8/2004 | Lee et al. | |
| 6,823,559 | B2 | 11/2004 | Kaffenberger et al. | |
| 7,150,068 | B1 | 12/2006 | Ragner | |
| 7,350,268 | B2 | 4/2008 | Anderson et al. | |
| 7,356,876 | B2 * | 4/2008 | Dant et al. | 15/414 |
| 7,367,085 | B2 | 5/2008 | Bagwell et al. | |
| 7,370,390 | B1 | 5/2008 | Muller | |
| 7,383,609 | B2 | 6/2008 | Ji | |
| 7,503,098 | B2 * | 3/2009 | Stein | 15/414 |
| 7,600,292 | B2 * | 10/2009 | Courtney | 15/351 |
| 7,805,804 | B2 * | 10/2010 | Loebig | 15/351 |
| 7,836,544 | B2 * | 11/2010 | Jansen | 15/320 |
| RE42,155 | E | 2/2011 | Ragner | |
| 7,950,102 | B2 | 5/2011 | Lee et al. | |
| 8,082,624 | B2 | 12/2011 | Myers | |
| 8,375,508 | B2 * | 2/2013 | Conrad | 15/345 |
| 8,448,295 | B2 * | 5/2013 | Vines et al. | 15/411 |
| 8,468,649 | B2 | 6/2013 | Nielsen et al. | |
| 8,528,166 | B2 * | 9/2013 | Morgan | 15/410 |
| 8,572,803 | B2 * | 11/2013 | Inge et al. | 15/354 |
| 8,627,545 | B2 * | 1/2014 | Streciwilk | 15/411 |
| 8,650,708 | B2 * | 2/2014 | Dyson et al. | 15/351 |
| 8,671,511 | B2 * | 3/2014 | Wills et al. | 15/351 |
| 8,869,349 | B2 * | 10/2014 | Henderson | 15/411 |
| 2001/0046407 | A1 | 11/2001 | Kunkler et al. | |
| 2002/0042962 | A1 | 4/2002 | Willman et al. | |
| 2002/0050016 | A1 | 5/2002 | Willman et al. | |
| 2002/0148057 | A1 * | 10/2002 | Hobden | 15/144.1 |
| 2002/0184726 | A1 | 12/2002 | Kingry et al. | |
| 2003/0009839 | A1 | 1/2003 | Streutker et al. | |
| 2003/0028988 | A1 | 2/2003 | Streutker et al. | |
| 2003/0034050 | A1 | 2/2003 | Policicchio et al. | |
| 2003/0052204 | A1 | 3/2003 | Aberegg et al. | |
| 2003/0074756 | A1 | 4/2003 | Policicchio et al. | |
| 2003/0095826 | A1 | 5/2003 | Policicchio et al. | |
| 2003/0126709 | A1 | 7/2003 | Policicchio et al. | |
| 2004/0211029 | A1 | 10/2004 | Ueda | |
| 2005/0223516 | A1 * | 10/2005 | Courtney | 15/351 |
| 2006/0277713 | A1 | 12/2006 | Sandlin et al. | |
| 2008/0263814 | A1 * | 10/2008 | Bassett et al. | 15/345 |
| 2009/0056057 | A1 | 3/2009 | Poetting | |
| 2009/0056058 | A1 * | 3/2009 | Finke et al. | 15/347 |
| 2009/0056065 | A1 | 3/2009 | Finke | |
| 2009/0056068 | A1 | 3/2009 | Iseringhausen et al. | |
| 2009/0089969 | A1 * | 4/2009 | Lee et al. | 15/411 |
| 2009/0165242 | A1 * | 7/2009 | Lee et al. | 15/411 |
| 2009/0300875 | A1 * | 12/2009 | Inge et al. | 15/354 |
| 2010/0154150 | A1 | 6/2010 | McLeod | |
| 2010/0229336 | A1 | 9/2010 | Conrad | |
| 2010/0236015 | A1 | 9/2010 | Worker et al. | |
| 2010/0236018 | A1 | 9/2010 | Vrdoljak et al. | |
| 2010/0319159 | A1 | 12/2010 | Gell et al. | |
| 2011/0023256 | A1 | 2/2011 | Conrad | |
| 2011/0088210 | A1 * | 4/2011 | White et al. | 15/410 |
| 2011/0107553 | A1 * | 5/2011 | Myers | 15/411 |
| 2011/0119863 | A1 * | 5/2011 | Ha et al. | 15/412 |
| 2012/0060322 | A1 * | 3/2012 | Simonelli et al. | 15/411 |
| 2012/0079679 | A1 * | 4/2012 | Seo | 15/415.1 |
| 2012/0233806 | A1 * | 9/2012 | Streciwilk | 15/347 |

FOREIGN PATENT DOCUMENTS

| | | |
|---|---|---|
| GB | 2433425 | 6/2007 |
| JP | S62-013508 U | 1/1987 |
| JP | S62101455 | 6/1987 |
| JP | S6432828 | 2/1989 |
| JP | 2234733 | 9/1990 |
| JP | 2237523 | 9/1990 |
| JP | 6090878 | 4/1994 |
| JP | H07317 | 1/1995 |
| JP | H11253372 | 9/1999 |
| JP | 2001340269 | 12/2001 |
| JP | 2005312535 | 11/2005 |
| JP | 2006026170 | 2/2006 |
| JP | 2006034520 | 2/2006 |
| JP | 2006326127 | 12/2006 |
| JP | 2008012361 | 1/2008 |
| JP | 2008036271 | 2/2008 |
| JP | 2009195488 | 9/2009 |
| WO | 2009/153525 | 12/2009 |
| WO | 2010/077959 | 7/2010 |
| WO | WO 2011112844 A1 * | 9/2011 |

OTHER PUBLICATIONS

PCT/US2011/056390 International Search Report and the Written Opinion of the International Searching Authority dated Feb. 8, 2012.

Chinese Patent Office Action for Application No. 2011800426117 dated Aug. 28, 2015 (13 pages, English translation included).

* cited by examiner

STEERING ASSEMBLY FOR SURFACE CLEANING DEVICE

BACKGROUND

The present invention relates to surface cleaning devices, and more particularly, to steering assemblies for surface cleaning devices.

SUMMARY

In one embodiment, the invention provides a surface cleaning device to clean a surface. The surface cleaning device has a foot, a handle assembly with a handle that can be manipulated by a user, and a steering assembly that is coupled between the handle assembly and the foot. The steering assembly defines an open path between the foot and the handle assembly and includes a biasing member. Movement of the handle assembly stores energy within the biasing member, such that the biasing member exerts a corresponding force on the foot.

In another embodiment, the invention provides a surface cleaning device to clean a surface. The surface cleaning device has a foot, a handle assembly with a handle that can be manipulated by a user, and a steering assembly that pivotally couples the handle assembly to the foot. The steering assembly defines an open path between the handle assembly and the foot and includes a first pivot member and a second pivot member. The first pivot member is coupled to a lower portion of the handle assembly, such that the first pivot member rotates with the handle assembly about a pivot axis. The second pivot member is coupled to the foot, such that the second pivot member rotates with the foot about the pivot axis. A biasing member couples the first and second pivot members together for relative rotation about the pivot axis and resists relative rotation between the first and second pivot member about the pivot axis. Rotation of the handle assembly and the first pivot member about the pivot axis stores energy within the biasing member, such that the biasing member exerts a corresponding force on the second pivot member and the foot to encourage turning of the foot.

In yet another embodiment, the invention provides a surface cleaning device to clean a surface. The vacuum cleaner has a foot, a handle assembly with a handle that can be manipulated by a user, and a steering assembly that couples the handle assembly to the foot. The steering assembly defines an open path between the handle assembly and the foot and includes a means for biasing the foot with respect to the handle assembly. Movement of the handle assembly stores energy within the biasing means, such that the biasing means exerts a corresponding force on the foot.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
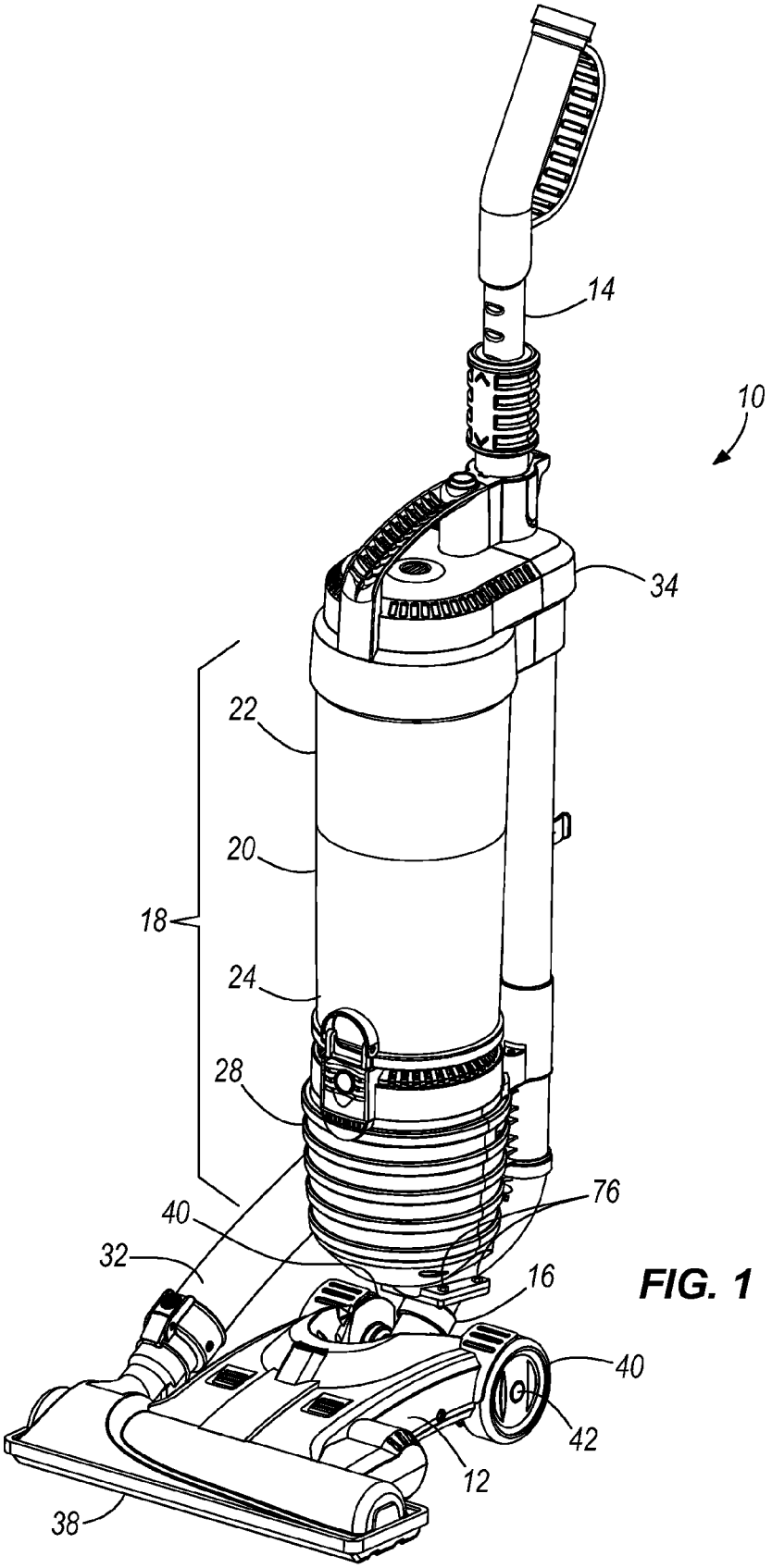
FIG. 1 is a perspective view of a surface cleaning device according to one embodiment of the invention.

FIG. 1 illustrates a surface cleaning device 10 that includes a nozzle, base, or foot 12 and a body or handle assembly 18 that is movably coupled to the foot 12 via a steering assembly 16. The illustrated surface cleaning device 10 is an upright style vacuum cleaner and the handle assembly 18 may include a handle 14, a canister 20, a fan and suction source 28, and a main power supply 34. In alternative embodiments, the suction source 28 may be located in the foot 12. The main power supply 34 may comprise a cordless power supply such as a battery, or alternatively, may comprise a corded supply with a cord that connects to and provides electricity from an AC power source such as a wall socket. The canister 20 may include a cyclonic separation chamber 22 and a dirt cup or dirt collection chamber 24 to collect dirt and debris separated by the cyclonic separation chamber 22. In other embodiments, the canister 20 can have flexible walls. In yet other embodiments, the canister may include a housing or fabric bag that houses a filter bag. In the illustrated embodiment, the canister 20 is coupled to the handle 14 such that the canister 20 pivots with the handle 14 with respect to the foot 12. The canister 20 is removably coupled to the handle 14 so that a user can remove the canister 20 from the handle 14 to empty the dirt cup 24. A fan or impeller and a motor may be located within the suction source 28 and the fan and the motor can be operable to generate an airflow or suction through the cyclonic separation chamber 22. In the illustrated embodiment, the suction source 28 is coupled to the handle 14 such that the suction source 28 moves with the handle 14 with respect to the foot 12.

A hose 32 is coupled to the foot 12 and the canister 20. The hose 32 provides fluid communication of air and debris from the foot 12 to the canister 20. In one embodiment, the hose 32 can include an electrical wire located within or coupled to a sidewall of the hose 32. The electrical wire can provide electrical power from the main power supply 34 to the foot 12 to power components located within the foot 12. For example, in one embodiment, the foot 12 includes an agitator or brush roll that is rotated by a motor separate from the main suction motor located within the suction source 28, and the electrical wire of the hose 32 provides power to the brush roll motor. In alternative embodiments discussed later herein, rather than using hose 32, the steering assembly 16 itself can provide fluid communication of air and debris from the foot 12 to the canister 20.

The foot 12 includes an inlet or suction opening 38 and wheels 40 to move the inlet 38 and surface cleaning device 10 along a surface to be cleaned. The illustrated wheels 40 are rear wheels and the surface cleaning device 10 also includes front wheels (not shown) rotatably coupled to the nozzle 12 immediately behind the suction opening 38 to support the front of the nozzle 12 for movement over the surface to be cleaned. The inlet 38 is in fluid communication with the hose 32 and canister 20 and draws air and debris from the surface to be cleaned into the canister 20. The wheels 40 are rotatable about an axle 42. In other embodiments, the width and placement of wheels 40 on foot 12 may vary based on the structure, size, weight distribution, and housing configuration of foot 12. In yet other embodiments, foot 12 may not include any wheels.

While the illustrated surface cleaning device 10 is an upright vacuum cleaner, in alternative embodiments, the surface cleaning device 10 may be a canister style vacuum cleaner (not shown). In this embodiment, the handle assembly does not include the canister. Rather, the canister is separate from the handle assembly. The canister may include the cyclonic separation chamber, the dirt cup, the motor housing, and the wheels. The handle assembly may include the handle and a tube coupled to the foot. The tube is coupled to the foot via the steering assembly. The steering assembly includes a biasing member and may take the form of any of the embodiments described below. The steering assembly may include an open path to fluidly couple the suction inlet of the foot to the tube and the separation chamber, or the hose can fluidly connect the suction inlet to the separation chamber. Similar to the upright style vacuum embodiment, rotation of the handle in the canister style vacuum embodiment causes the tube to rotate and store energy in the biasing member, which allows the steering assembly to steer the foot. Alternatively, surface cleaning device 10 is hand held or light duty vacuum.

In other embodiments, the surface cleaning device 10 is not a dry vacuum cleaner. Rather, the surface cleaning device 10 may be a wet vacuum cleaner capable of drawing in air, liquid and debris. Alternatively, the surface cleaning device 10 may be an extractor capable of both dispensing liquid and drawing in air, liquid, and debris. In yet other embodiments, the surface cleaning device 10 may be a steam cleaner that dispenses liquid or steam but does not include a suction source. In additional embodiments, surface cleaning device 10 may be a sweeper that includes a handle and a pivoting base that supports a wet or dry cloth that is positioned below the base. These sweepers do not dispense liquid and do not include a suction source. Regardless of what form surface cleaning device 10 takes, surface cleaning device 10 includes the steering assembly 16 movable coupled between the handle assembly 18 and the foot 12. In all embodiments, steering assembly 16 stores energy based on movement of the handle assembly 18 to steer the foot 12, as described in detail below.

Figure 2A:
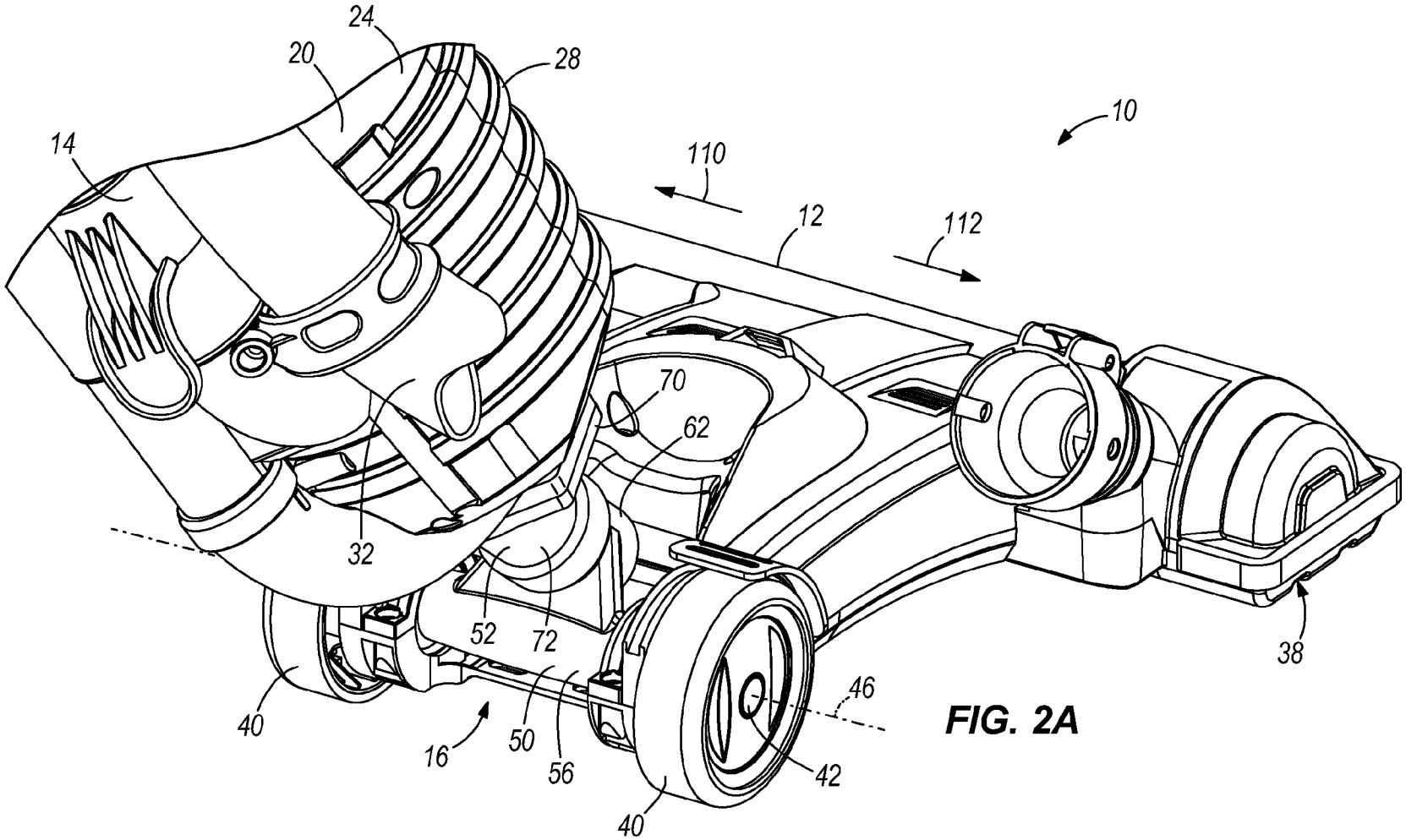
FIG. 2A is an enlarged perspective view of the surface cleaning device of FIG. 1 illustrating a steering assembly of the surface cleaning device.
Figure 2B:
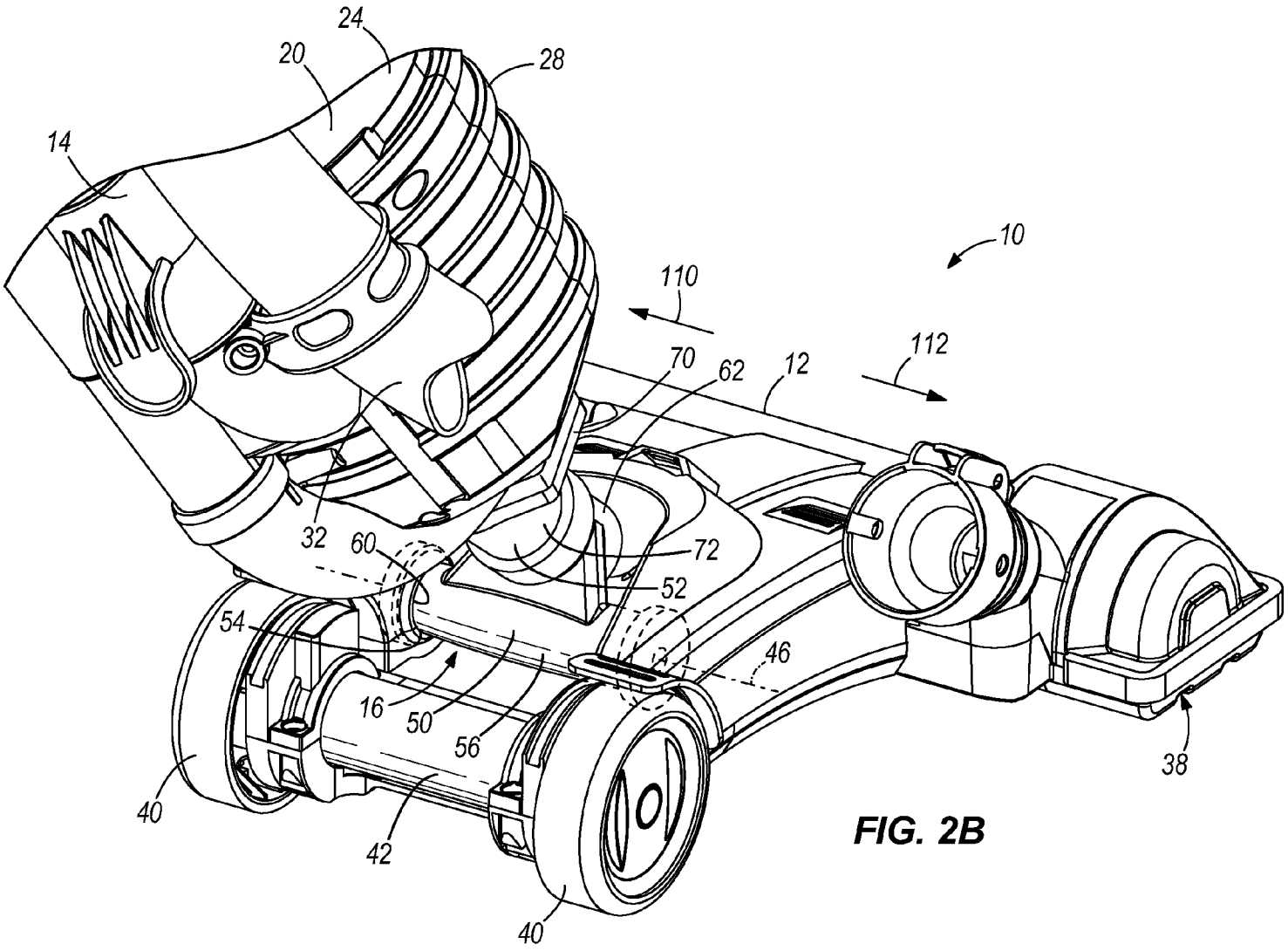
FIG. 2B is a view similar to FIG. 2A illustrating a surface cleaning device according to another embodiment of the invention.
Figure 3:
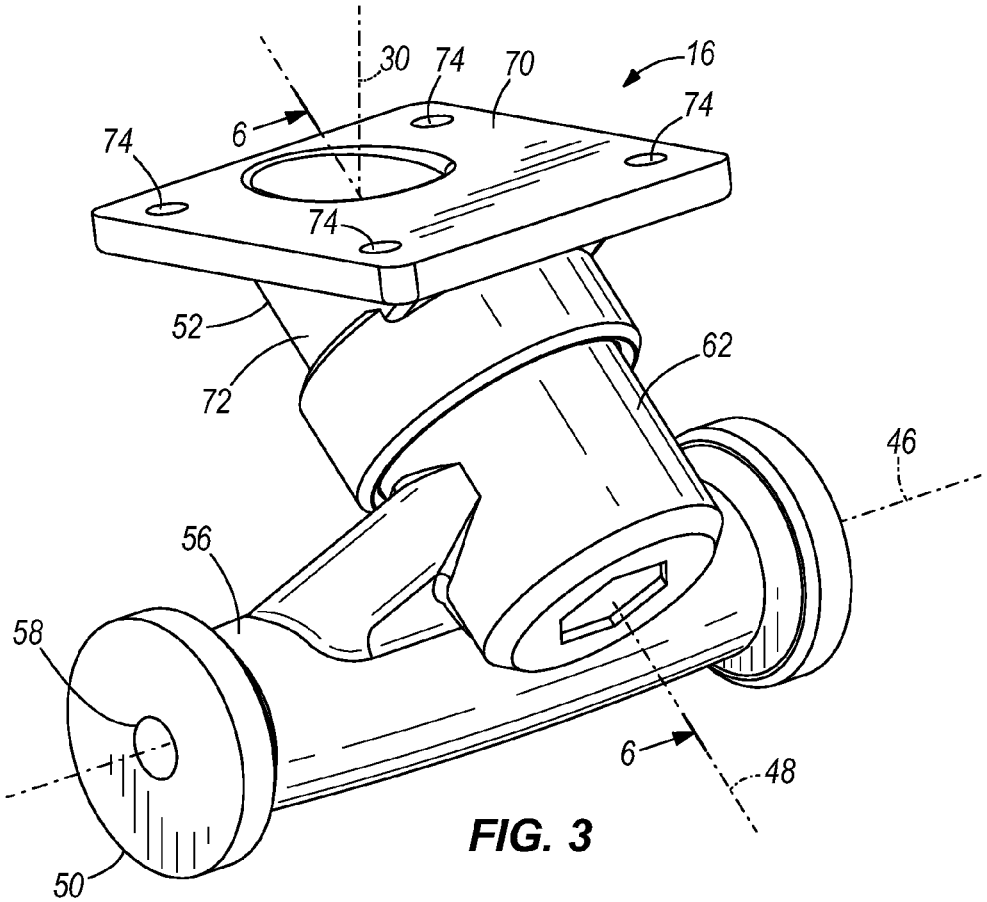
FIG. 3 is a perspective view of the steering assembly of FIG. 2.

Referring to FIGS. 1, 2, and 3, the steering assembly 16 allows the handle 14, and therefore the canister 20 and the suction source 28 (i.e., the handle assembly 18), to rotate about a horizontal axis 46 with respect to the foot 12 between an upright or storage position (FIG. 1) and multiple operating or inclined positions (one inclined position illustrated in FIG. 2) during use of the surface cleaning device 10. In the embodiment illustrated in FIG. 2A, the axle 42 is coincident with the horizontal axis 46, and in other embodiments (some of which are described in greater detail below), the axis 46 is offset from the axle 42. In some embodiments, the surface cleaning device 10 includes a locking mechanism (not shown) that holds the handle assembly 18 in the upright position. For example, the locking mechanism can include a projection from one of the handle assembly 18 and the foot 12 that is lockingly received within a recess of the other of the handle assembly 18 and the foot 12 to maintain the handle assembly 18 and the foot 12 coupled together in the upright position. The locking mechanism also can include a release latch that will allow the projection to be released from the recess thereby allowing pivoting of the handle assembly 18 relative to the foot 12 to an inclined position.

Figure 6:
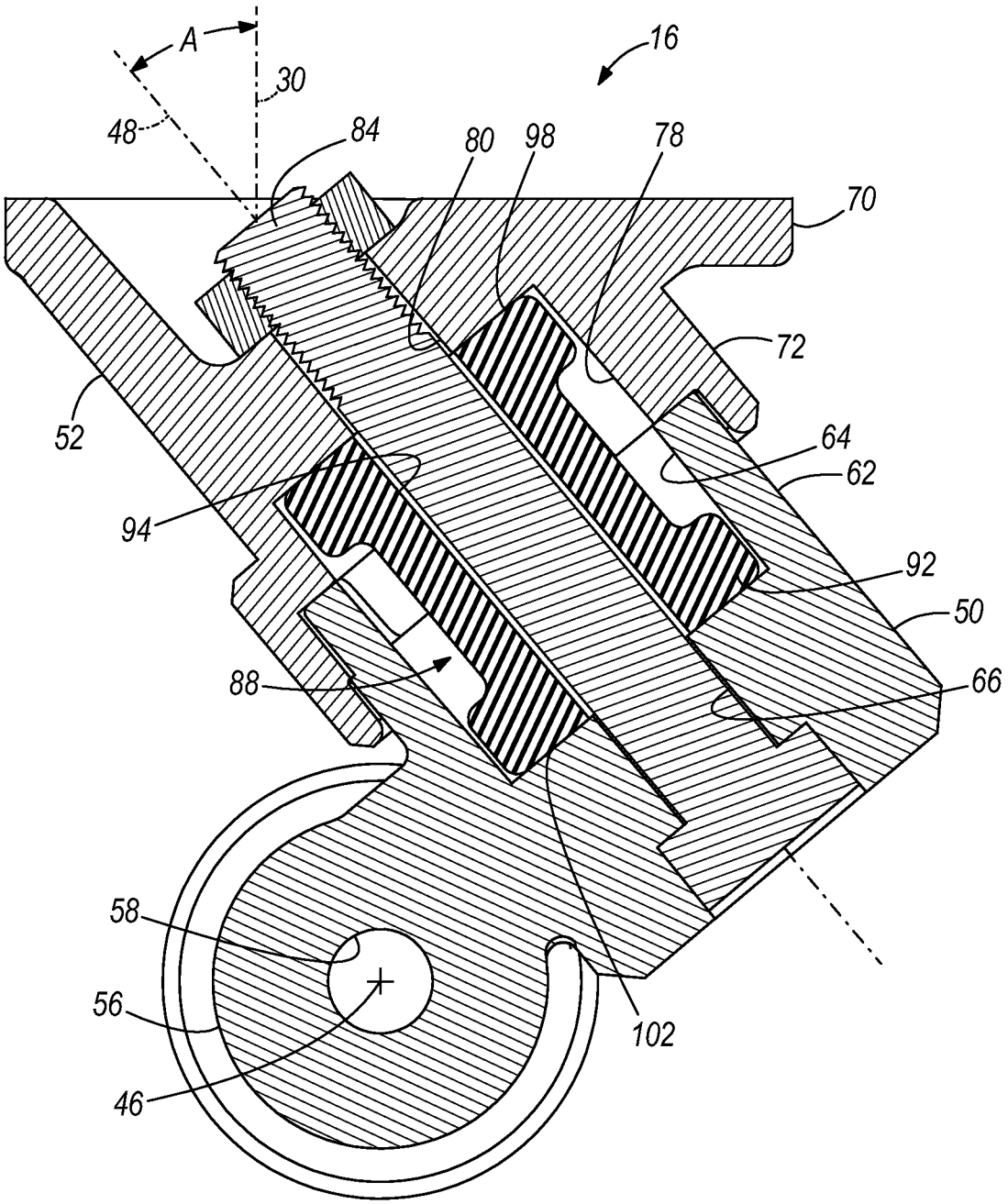
FIG. 6 is a cross-sectional view of the steering assembly taken along line 6-6 of FIG. 3.

Also, the steering assembly 16 allows the user to rotate the handle 14, and therefore the handle assembly 18, with respect to the foot 12 about an axis of rotation 48 to facilitate steering the foot 12 and the surface cleaning device 10 along the surface to be cleaned. In the illustrated embodiment, the axis 48 forms an acute angle A relative to a longitudinal axis 30 of the handle assembly 18. When the handle assembly 18 is in the vertical or upright position, the longitudinal axis 30 is vertical. When the handle assembly 18 is tilted about axis 46 away from the vertical or upright position, the same acute angle A is maintained between the axis of rotation 48 and the longitudinal axis 30. As shown in FIG. 6, the angle A is about 45 degrees. In other embodiments, the angle is between 40 and 50 degrees, between 30 and 60 degrees, or between 15 and 75 degrees.

The steering assembly 16 includes a first pivot member 52 and a second pivot member 50. The second pivot member 50 includes an elongated base 56 and an aperture 58 that extends through the elongated base 56. In the embodiment shown in FIG. 2A, the axle 42 of the wheels 40 extends through the aperture 58 to couple the second pivot member 50 to the foot 12 such that the second pivot member 50 rotates with respect to the foot 12 about the horizontal axis 46.

Alternatively, steering assembly 16 can be connected to the foot 12 in a position separate from the wheels 40 and the axle 42. In embodiments where the axis 46 is offset from the axle 42, the second pivot member 50 and the elongated base 56 are rotatably coupled directly to the top of the foot 12, forward of the wheels 40 and axle 42. For instance, in the embodiment shown in FIG. 2B, second pivot member 50 is rotatably connected to the foot 12 approximately three inches forward of the wheels 40 and the axle 42. The elongated base 56 rests on a pair of opposed ledges 54 within a pair of opposed cylindrical cavities 60 in the foot 12. In other embodiments, the axis 46 can be set rearward of wheels 40 and axle 42. The second pivot member 50 further includes a cylindrical flange 62 that is coupled to the base 56. As best seen in FIG. 6, the cylindrical flange 62 includes a cavity 64 and an aperture 66. The axis 48 extends centrally through the cavity 64 and the aperture 66.

Figure 5:
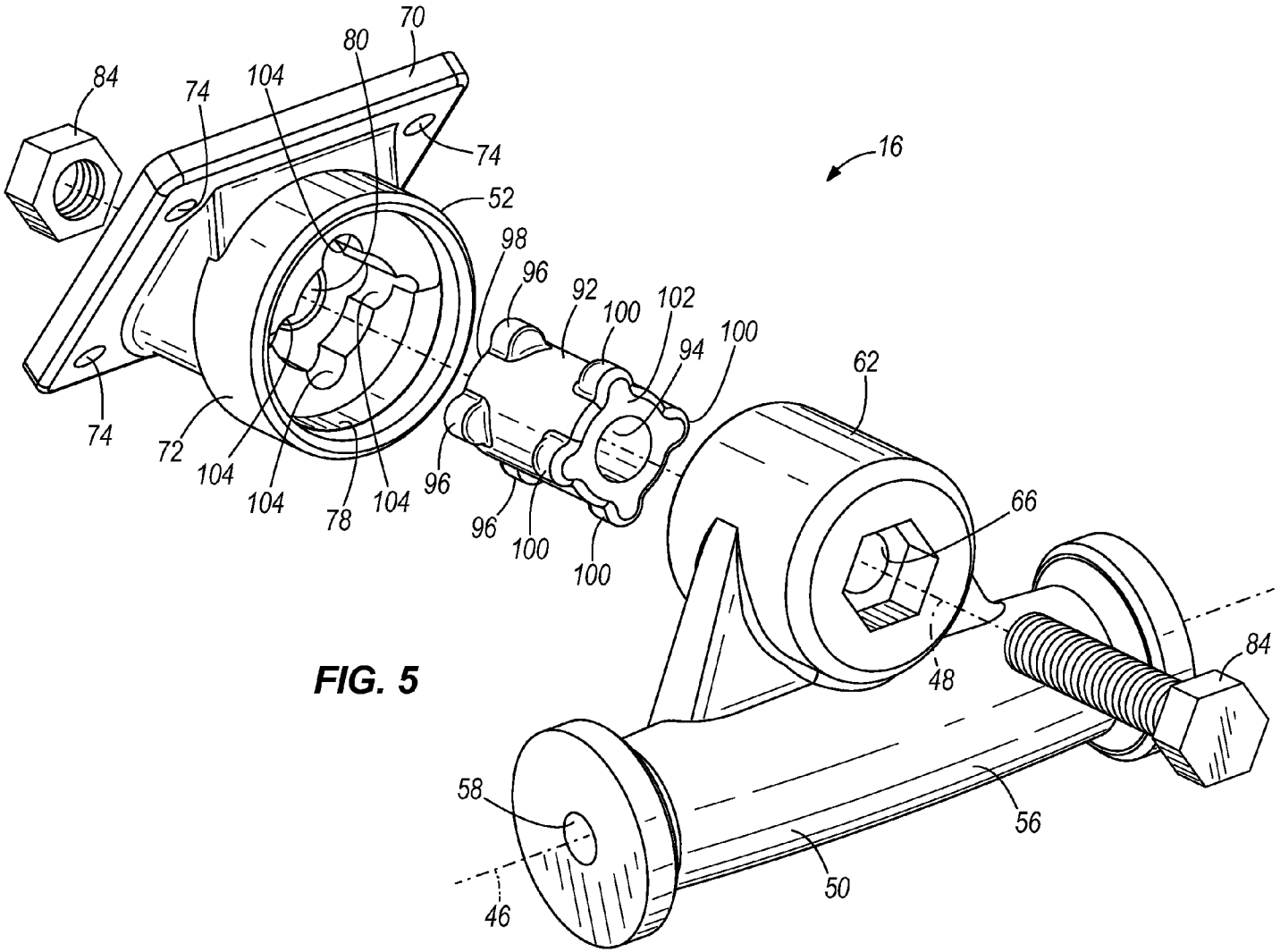
FIG. 5 is an exploded view of the steering assembly of FIG. 3.

Referring to FIG. 5, the first pivot member 52 includes a first, generally flat, flange 70 and a second, cylindrical, flange 72. The first flange 70 includes apertures 74 that receive fasteners 76 (FIG. 1) to couple the suction source 28, and thereby the handle assembly 18 to the steering assembly 16. In the illustrated embodiment, the first pivot member 52 is formed as a separate component from the handle assembly 18 and is coupled to the handle assembly 18 using the fasteners 76. In other embodiments, the first pivot member 52 can be integrally formed with other portions of the surface cleaning device 10. For example, in such embodiments, the first pivot member 52 can be molded as part of the suction source 28 or the handle 14. Similarly, in other embodiments, the second pivot member 50 may be integrally formed with and at any spot on the foot 12. As best seen in FIG. 6, the cylindrical second flange 72 includes a cavity 78 and an aperture 80. The axis 48 extends centrally through the cavity 78 and the aperture 80. In the illustrated embodiment, the flanges 70 and 72 are integrally formed as a single component, such as by molding the first pivot member 52 from plastic.

Referring to FIGS. 5 and 6, the steering assembly 16 further includes a fastener 84 to couple the second pivot member 50 and the first pivot member 52 such that the pivot members 50, 52 can rotate with respect to each other about the axis 48. In one embodiment, the pivot members 50, 52 include a mechanical stop, such as a tab, rib, or the like, to limit relative rotation between the pivot members 50, 52 about the axis 48. In one such embodiment the relative rotation about the axis 48 is limited to about 120 degrees. In yet other embodiments, the relative rotation about the axis 48 may be expanded to 240 or even 360 degrees.

The fastener 84 may include a nut and a bolt, as in the illustrated embodiment, which extends through the aperture 80 of the first pivot member 52 and the aperture 66 of the second pivot member 50. In other embodiments, the fastener 84 may comprise a snap engagement. For instance, the fastener 84 may comprise a living spring with a tab that snaps into a corresponding engagement of the aperture 80. The pivot members 50, 52 are coupled such that the cavities 64, 78 are joined to form a cavity 88 that includes both of the cavities 64, 78.

The steering assembly 16 further includes a biasing member 92 that stores energy to facilitate steering the foot 12 of the surface cleaning device 10. In the illustrated embodiment, the biasing member 92 is a torsion spring in the form of a resilient piece of molded rubber having a durometer of about 90 A. In other embodiments, the biasing member 92 can be formed from other suitable materials having a different durometer, such as in a range of 80-100, and can be other suitable types of torsions springs, such as a coil spring. For example, in embodiments where the surface cleaning device 10 is hand held or light duty vacuum, the durometer would be lower than if the surface cleaning device is an upright vacuum cleaner. In other embodiments, the biasing member 92 may comprise two distinct biasing members having the same or different durometers connected, for instance, via corresponding splines. In yet other embodiments, the biasing member 92 may be any member or mechanism capable of storing energy, such as a compression spring, a torsion bar, a torsion fiber, a magnet, a pneumatic, or a hydraulic member. Whatever form the biasing member 92 takes, the biasing member 92 device functions to store mechanical energy when the handle assembly 18 is twisted relative to the foot 12. The stored energy is then used to bring the steering assembly 16 back to center after it has been rotated by a user when the foot 12 is rolled forwards or backwards during use.

With continued reference to FIGS. 5 and 6, the biasing member 92 includes an aperture 94 that extends longitudinally through the biasing member 92. The fastener 84 extends through the aperture 94 to couple the biasing member 92 to the second pivot member 50 and the first pivot member 52. Also, rounded knobs 96 are located at a first end 98 of the biasing member 92 and rounded knobs 100 are located at a second end 102 of the biasing member 92. The knobs 96 are received in recesses 104 of the first pivot member 52 having a shape corresponding to the shape of the knobs 98. Likewise, the knobs 100 are received in recesses of the second pivot member 50 (not visible in FIG. 5) similar to the recesses 104 of the first pivot member 52. The knobs 96 inhibit rotation of the first end 98 of the biasing member 92 with respect to the first pivot member 52 and the knobs 100 inhibit rotation of the second end 102 of the biasing member 92 with respect to the second pivot member 50. However, the biasing member 92 is resilient such that the ends 98 and 102 of the biasing member 92, and therefore the second pivot member 50 and the first pivot member 52, can rotate with respect to each other about the axis 48 and yet the biasing member 92 returns to the position illustrated in FIG. 3. Although the knobs 96 and 100 and recesses 104 are rounded in the illustrated embodiment, in other embodiments, the knobs and recesses can take other suitable shapes. In yet other embodiments, adhesives, fasteners, and the like can be used to couple the ends 98 and 102 of the biasing member 92 for rotation with the respective first pivot member 52 and the second pivot member 50.

Figure 4:
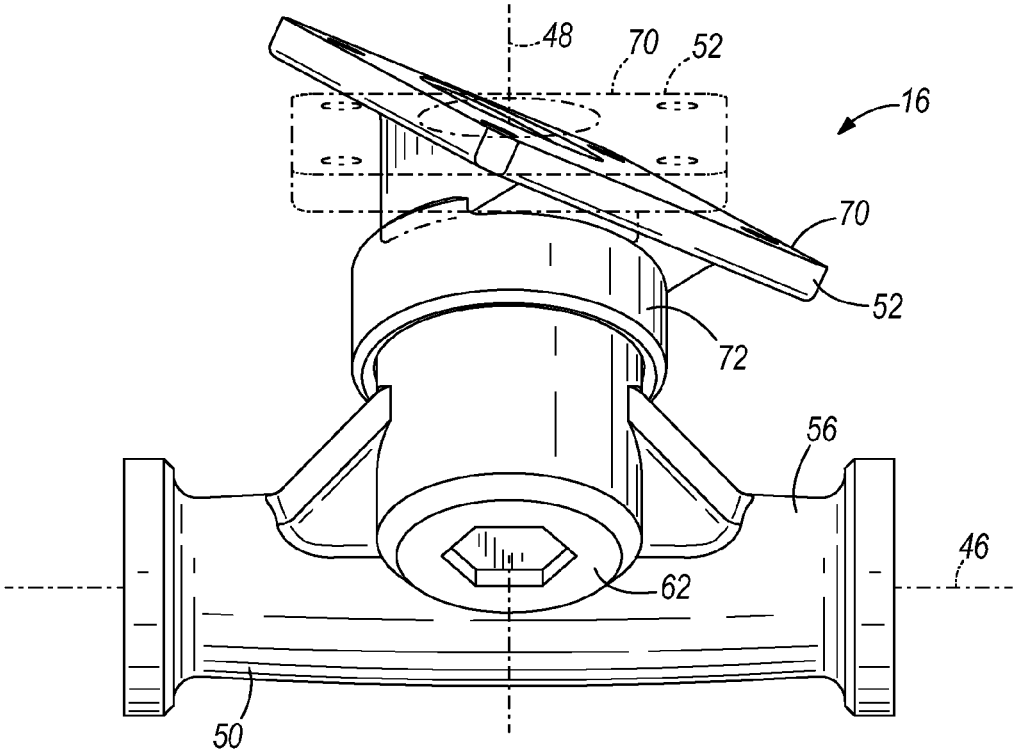
FIG. 4 is a front side view of the steering assembly of FIG. 3 illustrating a flange of the assembly rotated.

In operation, the handle 14 is typically in an upright position (FIG. 1) with respect to the foot 12 when the surface cleaning device 10 is not in use or is being stored. When the user desires to use the surface cleaning device 10 to clean a surface, the user pivots the handle 14 and the handle assembly 18 about the horizontal axis 46 with respect to the foot 12 to an inclined position (FIG. 2). The inclined positions of the handle 14 and the handle assembly 18 vary during use of the surface cleaning device 10 as the user uses the handle 14 to move the foot 12 in forwards and backwards directions along the surface. Also, the user can steer the foot 12 to move the foot 12 generally in horizontal directions (generally represented by arrows 110 and 112 of FIG. 2) along the surface being cleaned. To steer the foot 12, the user rotates the handle 14, and therefore the handle assembly 18, with respect to the foot 12 about the axis 48 (FIGS. 3 and 4). When the user rotates the handle assembly 18 about the axis 48, the first pivot member 52, which is coupled for rotation with the handle assembly 18 about the axis 48, rotates with respect to the second pivot member 50, which is fixed from rotation about the axis 48 with respect to the foot 12. Rotating the first pivot member 52 with respect to the second pivot member 50 causes the first end 98 of the biasing member 92 to rotate with respect to the second end 102 of the biasing member 92. The resilient properties of the biasing member 92 cause the biasing member 92 to resist rotation of the handle assembly 18 with respect to the foot 12 about the axis 48. However, this resistance and energy stored in the biasing member 92 by rotation of the handle assembly 18 about the axis 48, moves the foot 12 in either direction of arrows 110 or 112 depending on which direction the user rotates the handle 14 about the axis 48 when the foot 12 is being rolled in the forward direction. When the user no longer desires to turn the foot 12 in the direction 110 or 112 the user releases or stops turning the handle 14 and the handle assembly 18 about the axis 48. The handle assembly 184 then rotates about the axis 48 back to the position illustrated in FIG. 2 (also illustrated by phantom lines in FIG. 4) because of the resiliency and recovery forces of the biasing member 92.

Specifically, when the handle 14 is in an inclined position and the foot 12 is not moving forwards or backwards, any rotation of the handle 14 about the axis 48 will result in twisting of the biasing member 92 to store energy in the biasing member 92. The stored energy is released from the biasing member 92 when the foot 12 is rolled forwards or backwards. For example, if the handle 14 is twisted left, then the stored energy of the biasing member 92 will turn the front of the foot 12 toward the left direction 110 when the foot 12 is rolled forwards thereby bringing the steering assembly 16 back to its original, unbiased position. Also, if the handle 14 is twisted left, then the stored energy of the biasing member will turn the back of the foot 12 toward the left direction 110 when the foot 12 is rolled backwards thereby bringing the steering assembly 16 back to its original, unbiased position. Likewise, if the handle 14 is twisted right, then the stored energy of the biasing member 92 will turn the front of the foot 12 toward the right direction 112 when the foot 12 is rolled forwards thereby bringing the steering assembly 16 back to its original, unbiased position. Also, if the handle 14 is twisted right, then the stored energy of the biasing member 92 will turn the back of the foot 12 toward the right direction 112 when the foot 12 is rolled backwards thereby bringing the steering assembly 16 back to its original, unbiased position. In this manner, the steering assembly 16 smoothly transitions user-actuated twisting of the handle 14 into a delayed yet seamless steering of the foot 12.

Therefore, the steering assembly 16 allows the user to pivot the handle 14 with respect to the foot 12 about the horizontal axis 46 from the upright position to one of the inclined positions. Also, the steering assembly 16 allows the user to rotate the handle 14 with respect to the foot 12 about the axis 48 which facilitates steering the foot 12 along the surface being cleaned. Furthermore, the steering assembly 16 includes the biasing member 92 which allows the steering assembly 16 to steer the foot 12 and return the handle 14 to its original position about the axis 48.

Figure 7:
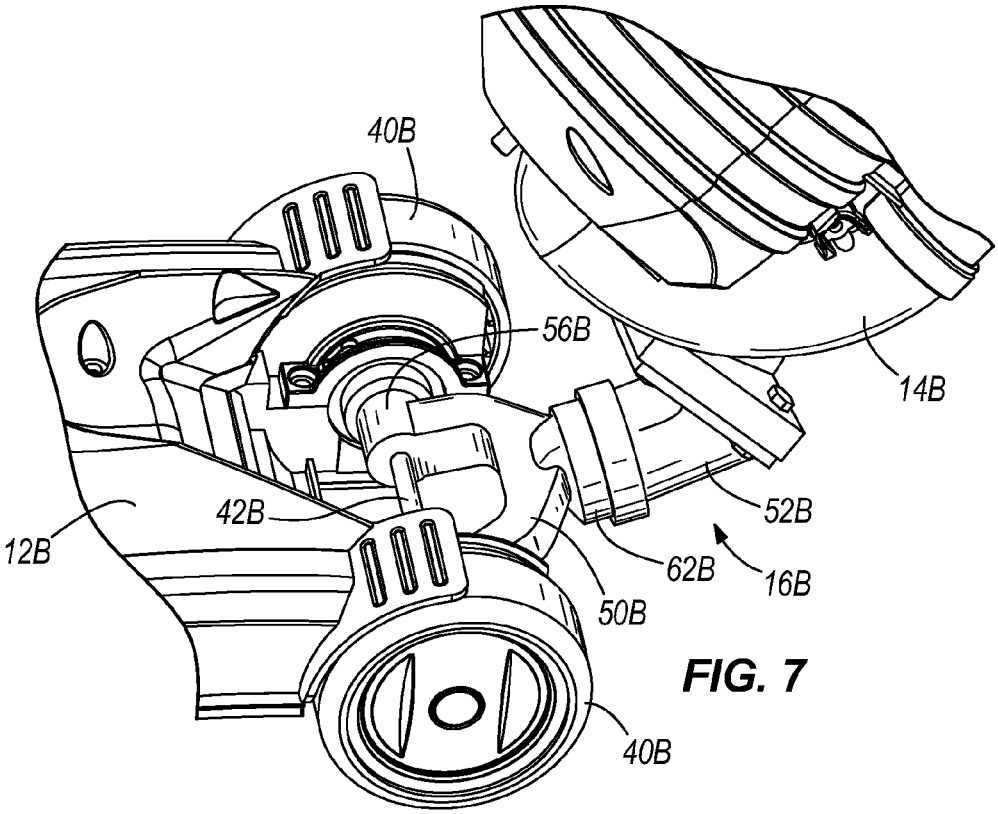
FIG. 7 is a perspective view of a portion of a surface cleaning device including a steering assembly according to another embodiment of the invention.
Figure 8:
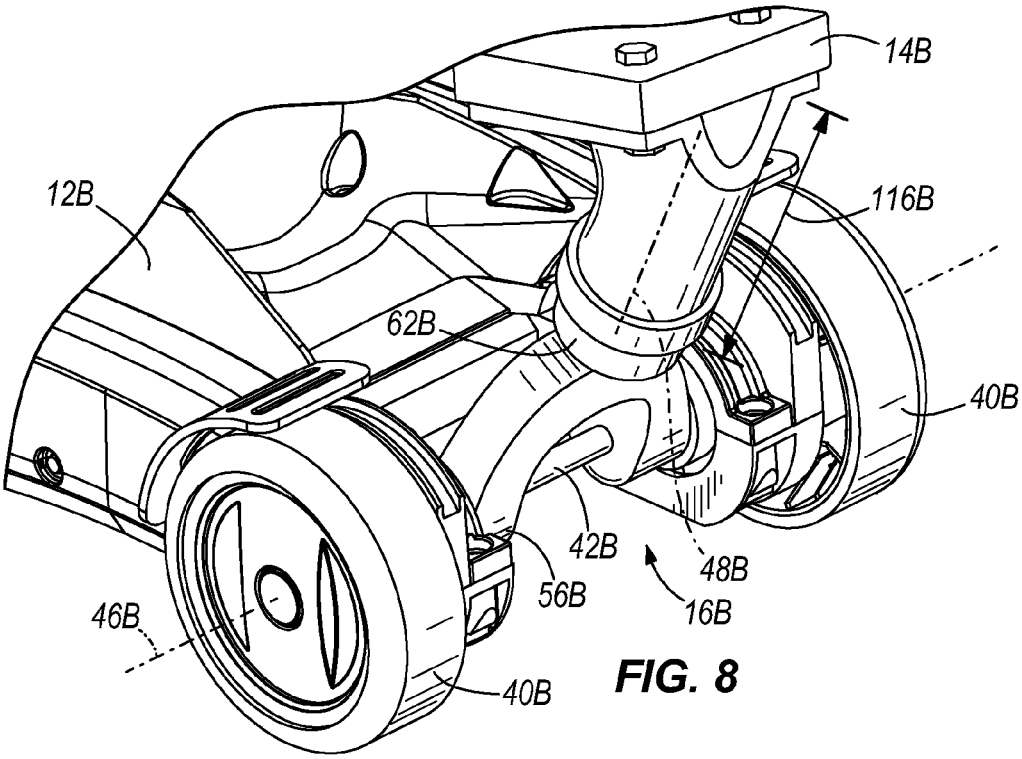
FIG. 8 is an alternative perspective view of the surface cleaning device of FIG. 7.

FIGS. 7 and 8 illustrate a steering assembly 16B according to another embodiment of the invention. The steering assembly 16B is similar to the steering assembly 16 of FIGS. 1-6 and like components have been given like reference numbers with the addition of the suffix 'B,' and only the differences between the steering assemblies 16 and 16B will be discussed in detail. The steering assembly 16B includes similar components and operates in a similar manner to the steering assembly 16 of FIGS. 1-6. However, the first pivot member 52B has a relatively long length 116B and the base 56B and the flange 62B of the second pivot member 50B are alternatively positioned with respect to each other to position the handle 14B with respect to the foot 12 in a slightly different and higher position with respect to the surface being cleaned.

Figure 9:
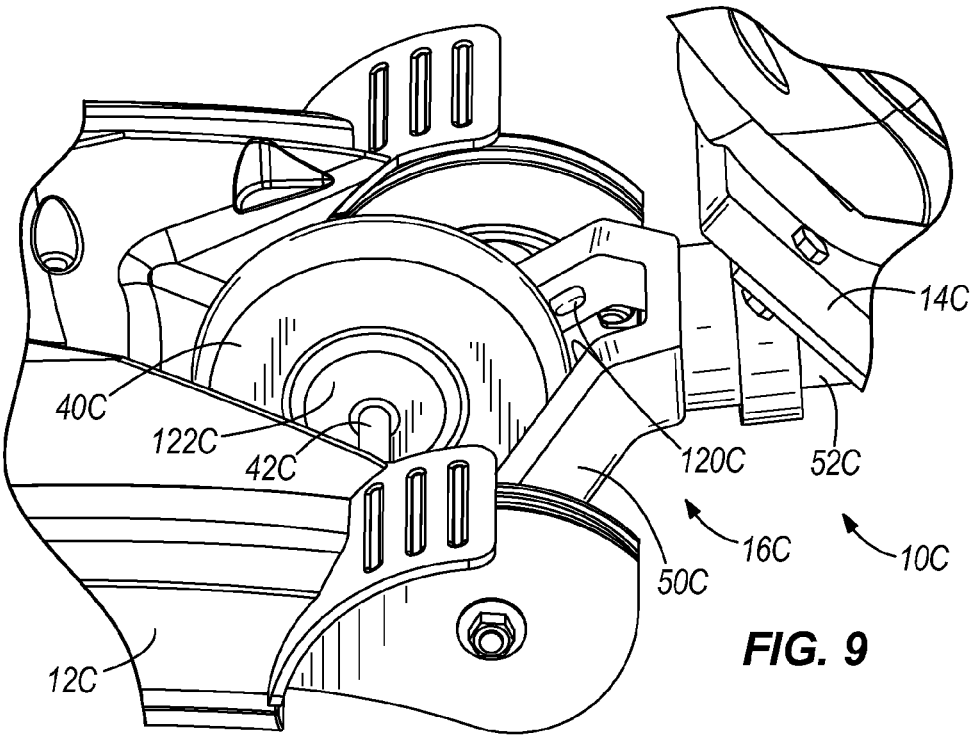
FIG. 9 is a perspective view of a portion of a surface cleaning device including a steering assembly according to another embodiment of the invention and showing a handle of the surface cleaning device in an inclined position during use of the surface cleaning device.
Figure 10:
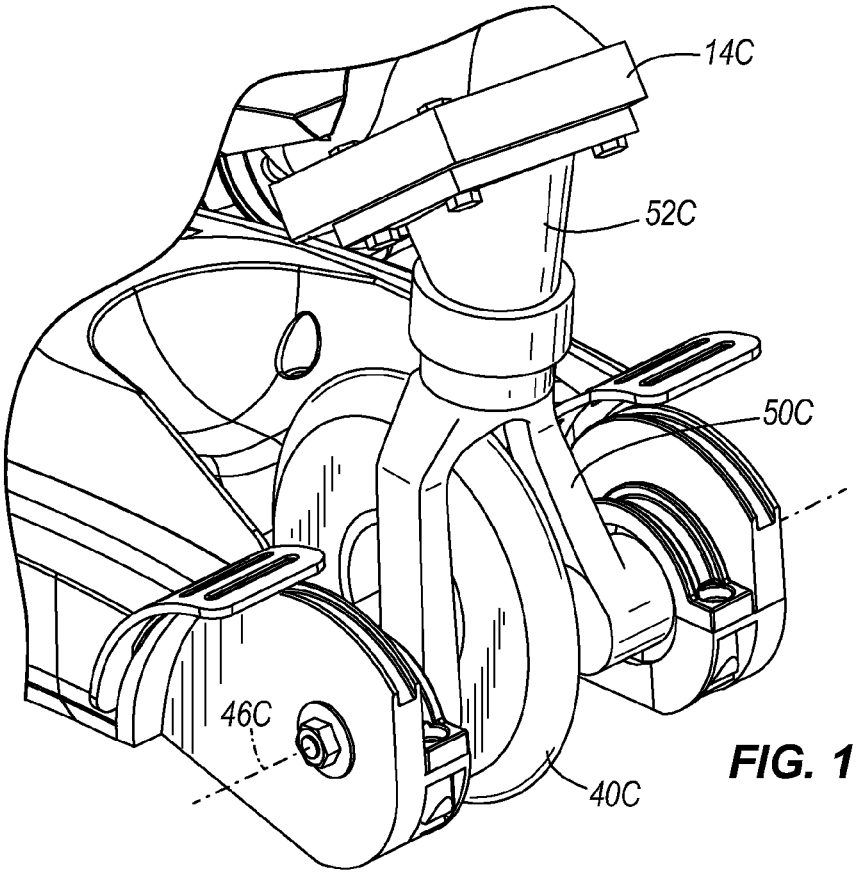
FIG. 10 is an alternative perspective view of the surface cleaning device of FIG. 9 illustrating the handle in an upright position.

FIGS. 9 and 10 illustrate a steering assembly 16C according to another embodiment of the invention. The steering assembly 16C is similar to the steering assemblies 16 and 16B of FIGS. 1-8 and like components have been given like reference numbers with the addition of the suffix 'C,' and only the differences between the steering assemblies 16, 16B, and 16C will be discussed in detail. The steering assembly 16C is configured for use with a surface cleaning device 10C that includes a single rear wheel 40C as opposed to the surface cleaning devices 10 and 10B that include multiple wheels 40 and 40B, respectively. In addition, the horizontal axis 46C is not coincident with the axle 42C. The second pivot member 50C also includes tabs 120C. The tabs 120C engage a rim 122C of the wheel 40C to retain the handle 14C in the upright position (FIG. 10). However, when the handle 14C is in the upright position, the handle 14C pivots slightly with respect to the foot 12C about axis 46C to create a small gap between the outer periphery of the wheel 40C and the second pivot member 50C. Therefore, the wheel 40C can roll about axle 42C to move or trundle the surface cleaning device 10C with the handle 14C in the upright position. However, when in the upright position the handle 14C can pivot slightly while the tabs 120C are engaged with the rim 122C so that the second pivot member 50C rests on the outer periphery of the wheel 40C to inhibit rotation of the wheel 40C so the wheel 40C, and the surface cleaning device 10C, do not roll along the surface when the handle 14C is in the storage position.

Also, in the illustrated embodiment of FIGS. 9-10, the wheel 40C includes a transparent outer periphery. A light source and a generator are located within the transparent outer periphery. In operation, as the wheel 40C rotates about the axle 42C, the generator provides power to illuminate the light source. However, the generator does not provide enough power to illuminate the light source until the wheel 40C rotates about the axle 42C above a predetermined speed. The predetermined speed can be a preferred speed for moving the foot 12C along the surface being cleaned to achieve the greatest vacuuming efficiency.

Figure 11:
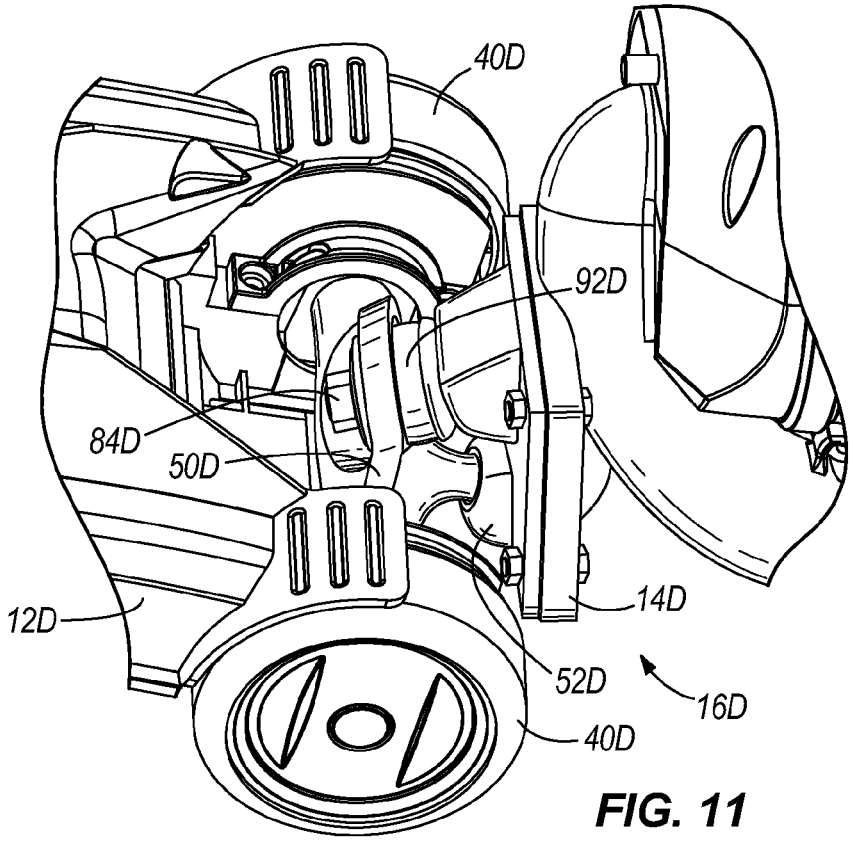
FIG. 11 is a perspective view of a portion of a surface cleaning device including a steering assembly according to another embodiment of the invention.

FIG. 11 illustrates a steering assembly 16D according to another embodiment of the invention. The steering assembly 16D is similar to the steering assemblies 16, 16B, and 16C of FIGS. 1-10 and like components have been given like reference numbers with the addition of the suffix 'D,' and only the differences between the steering assemblies 16, 16B, 16C, and 16D will be discussed in detail. The steering assembly 16D has a biasing member 92D that differs from the biasing member 92 of FIGS. 1-6. The biasing member 92D is a resilient elastomeric component that is received within an aperture of the second pivot member 50D. The shape of the elastomeric component 92D is changed by rotating the fastener 84D to apply more or less compressive force to the component 92D. The fastener 84D is rotated to change the amount of resistance the component 92D applies to relative rotation of the second pivot member 50D with respect to the first pivot member 52D.

Figure 12:
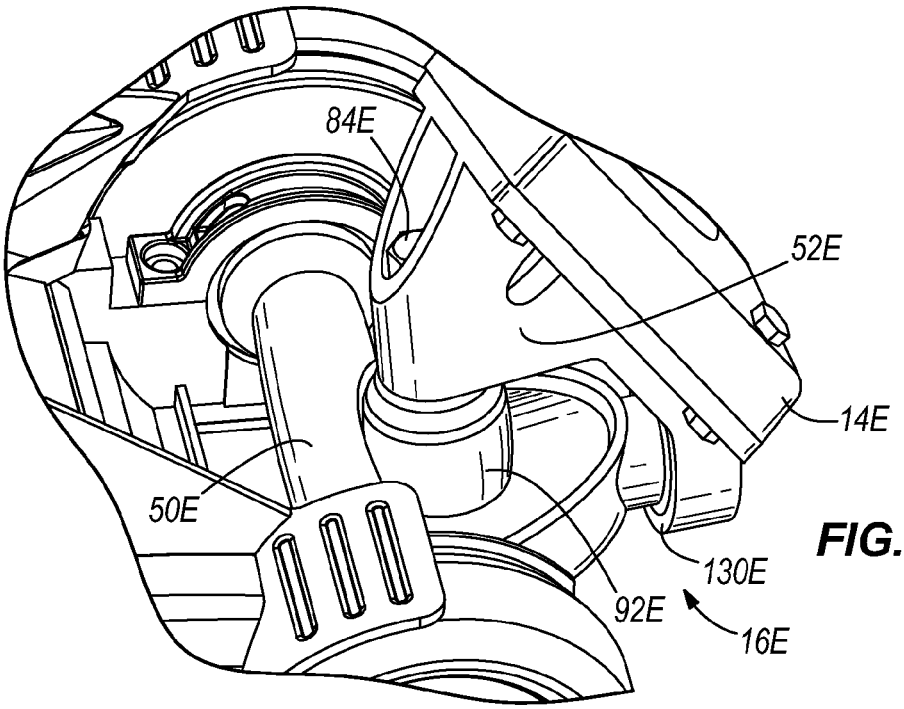
FIG. 12 is a perspective view of a portion of a surface cleaning device including a steering assembly according to another embodiment of the invention.
Figure 13:
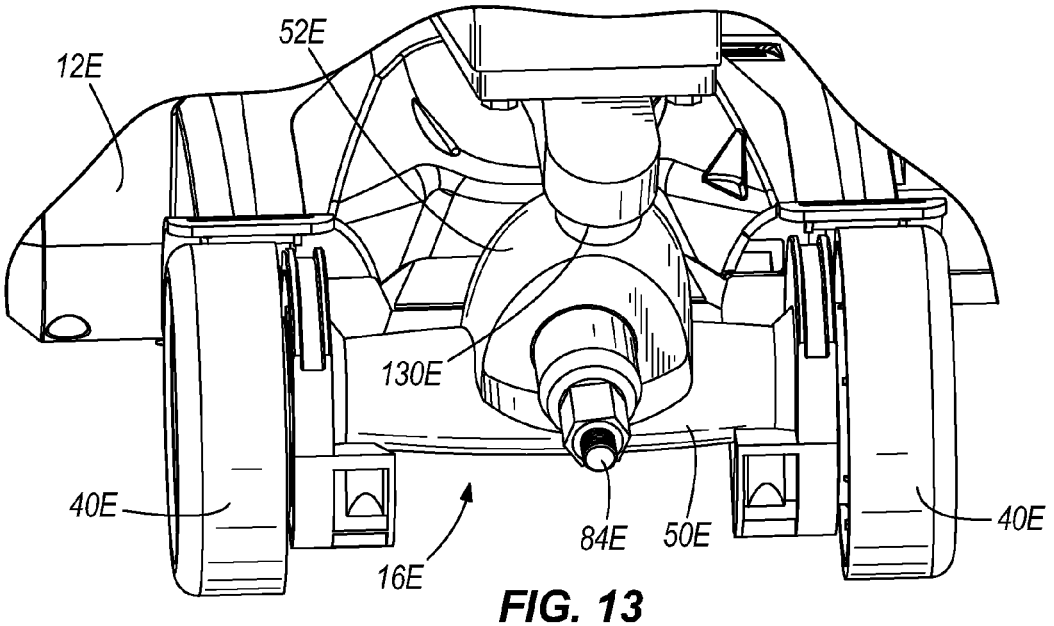
FIG. 13 is an alternative perspective view of the surface cleaning device of FIG. 12.

FIGS. 12-13 illustrate a steering assembly 16E according to another embodiment of the invention. The steering assembly 16E is similar to the steering assemblies 16, 16B, 16C, and 16D of FIGS. 1-11 and like components have been given like reference numbers with the addition of the suffix 'E,' and only the differences between the steering assemblies 16, 16B, 16C, 16D, and 16E will be discussed in detail. The steering assembly 16E includes an additional pivoting coupling 130E between the second pivot member 50E and the first pivot member 52E. In this embodiment, the handle assembly 18E is tilted left or right, rather than twisted, to steer the foot 16E left or right. Specifically, when the handle assembly 18E is tilted, steering mechanism 16E rotates around the axis defined by the 84E, and the biasing member 92E stores energy to cause the foot 12E to steer in the direction the handle assembly 18E is tilted.

Figure 14:
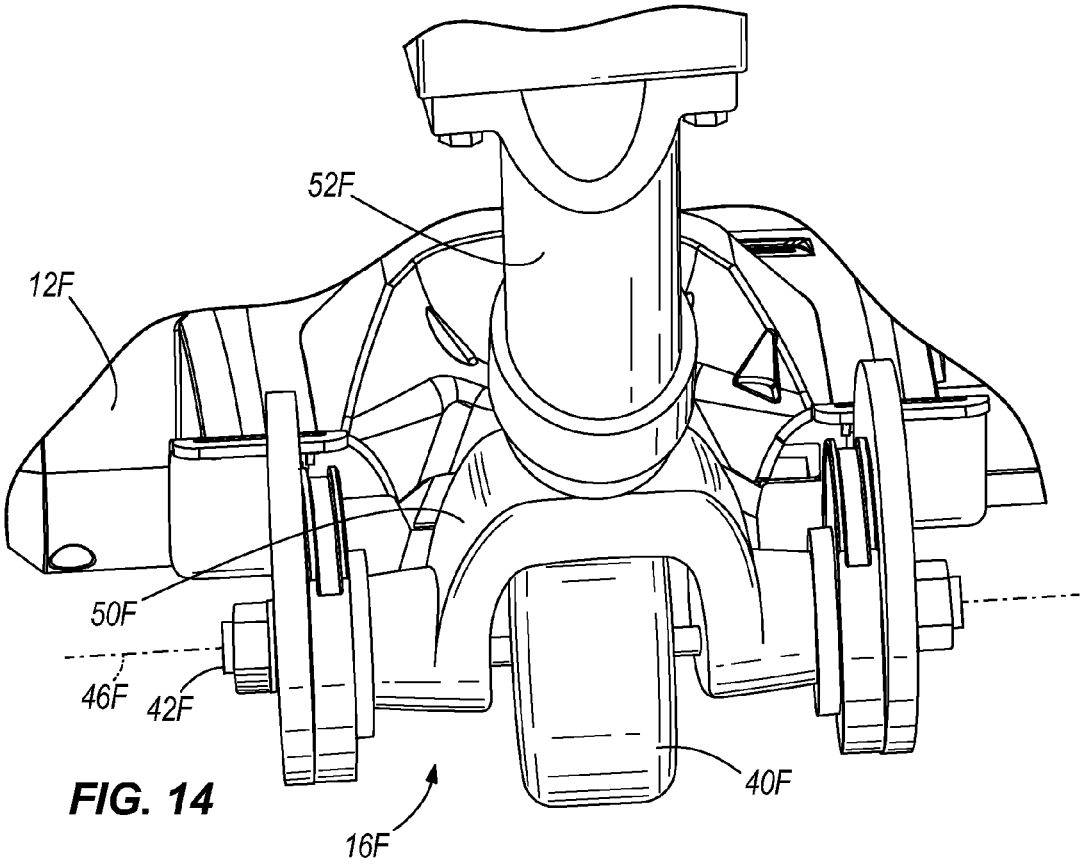
FIG. 14 is a perspective view of a surface cleaning device including a steering assembly according to another embodiment of the invention.

FIG. 14 illustrates a steering assembly 16F according to another embodiment of the invention. The steering assembly 16F is similar to the steering assemblies 16, 16B, 16C, 16D, and 16E of FIGS. 1-13 and like components have been given like reference numbers with the addition of the suffix 'F,' and only the differences between the steering assemblies 16, 16B, 16C, 16D, 16E, and 16F will be discussed in detail. The steering assembly 16F illustrates an alternative embodiment configured for use with a foot 12F having a single rear wheel 40F with its axle 42F being coaxial with the horizontal axis 46F of the steering assembly 16F. As described above, the width of the wheel 40F may vary depending on the structure, size, weight distribution, and housing configuration of foot 12F.

FIGS. 15-18 illustrate an open path steering assembly 16G according to another embodiment of the invention. The steering assembly 16G is described with reference to the surface cleaning device 10, described above, where like components have been given like reference numbers with the addition of the suffix 'G.' Unlike steering assemblies 16, 16B, 16C, 16D, 16E and 16F of FIGS. 1-14, the open path steering assembly 16G provides an open path through the steering assembly 16G itself The open path can be used to fluidly communicate air and debris from the foot 12G to the handle assembly 18G in place of the hose 32, which was discussed in the first embodiment. Alternatively, in embodiments where surface cleaning device 10 is a wet vac, extractor, or steam cleaning device, the open path may be used to communicate liquid drawn from the foot 12G to the handle assembly 18G, or may be used to communicate liquid from the handle assembly 18G to be dispensed on the surface via the foot 12G. In other embodiments, the open path can be used to route or provide a path for any number of vacuum components, such as a power cord from the power supply 34G down to the foot 12G, to power components located within the foot 12G such as a brush roll motor or lights positioned in the foot.

Figure 17:
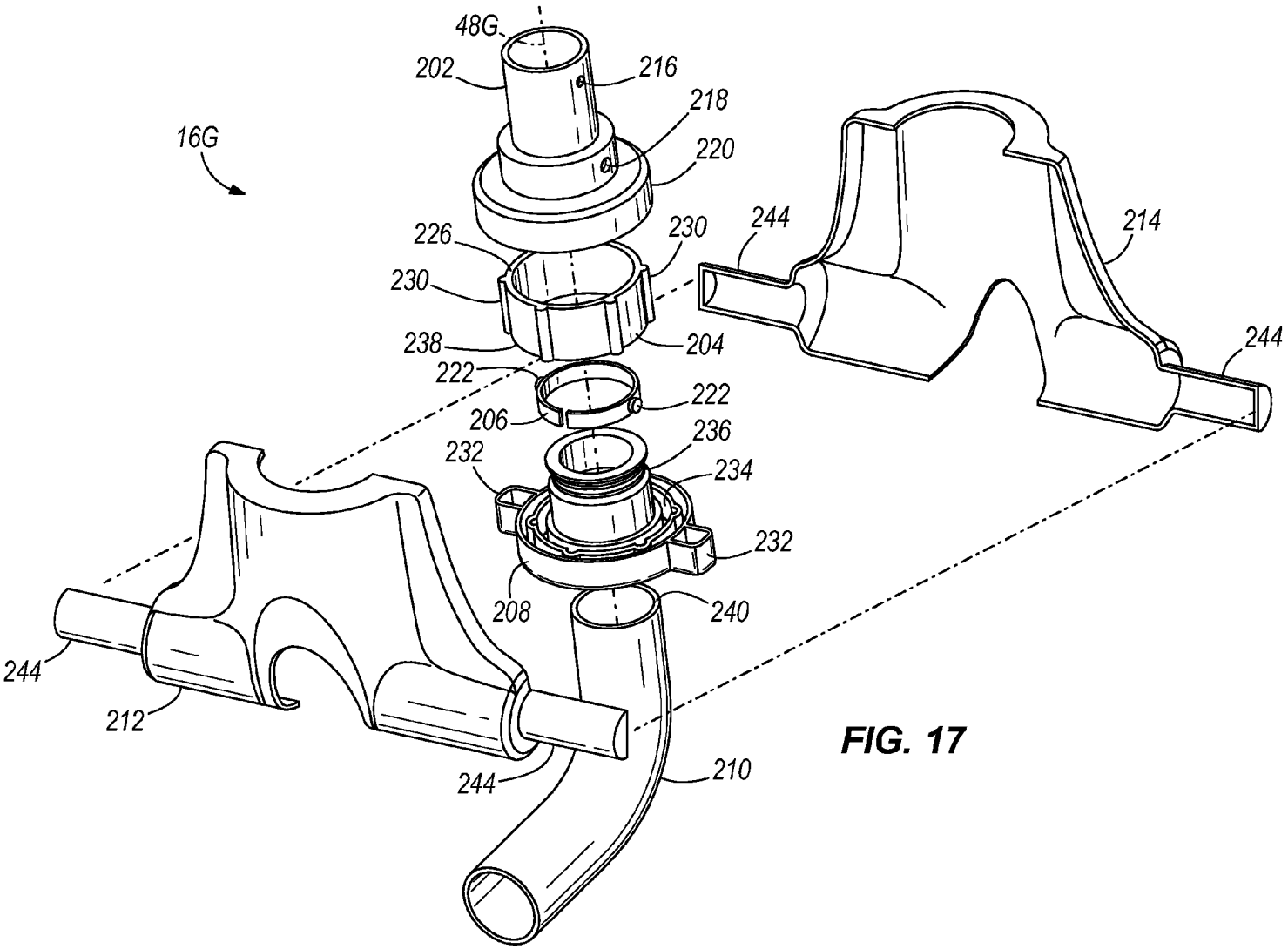
FIG. 17 is an exploded view of the steering assembly of FIG. 15.
Figure 18:
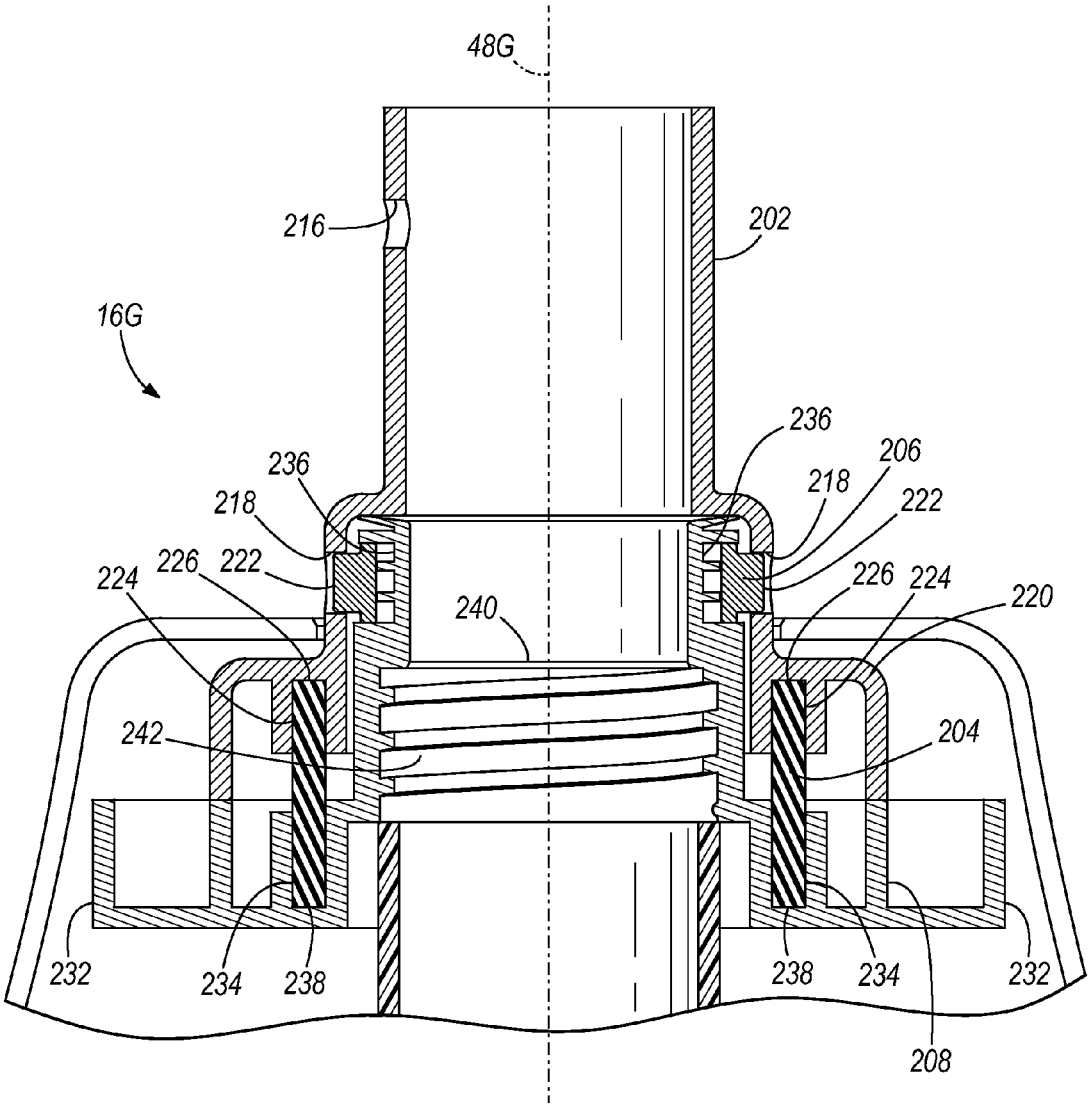
FIG. 18 is a cross-sectional view of the steering assembly taken along line 18-18 of FIG. 15.

Referring to FIGS. 17-18, the open path steering assembly 16G includes a steering tube 202, a biasing member 204, a lock ring 206, a steering lock 208, a hose 210, and front and rear covers 212, 214. The open path constitutes an open conduit that extends from the steering tube 202 down through the hose 210. The hose 210 is fluidly connected to a suction opening 38G of the foot 12G and is also fluidly connected to the cyclonic separation chamber 22G in the canister 20G. In this manner, the fan or impeller and motor located within the suction source 28G can generate an airflow or suction through the open path.

Steering tube 202 includes an assembly aperture 216, one or more ring apertures 218, and a lower lip 220. The assembly aperture 216 is designed to receive a corresponding protrusion (not shown) in the handle assembly 18G, such that as the handle 14G and the handle assembly 18G are rotated about a longitudinal axis 48G of steering tube 202, the corresponding protrusion received in the assembly aperture 216 causes the steering tube 202 to rotate in the same manner about the axis 48. Additionally, assembly aperture 216 can receive a protrusion from handle assembly 18G to removably lock the handle assembly 18G to the steering tube 202, such that removing the protrusion from the assembly aperture 216 allows the steering assembly 16G to be detached from the steering tube 202. The one or more ring apertures 218 are designed to receive one or more lock protrusions 222 of the lock ring 206. The lower lip 220 has a recess 224 (FIG. 18) around its circumference that is adopted to receive and create an interference fit with a tube side 226 of the biasing member 204. The width of the recess 224 may vary around its circumference in order to accommodate reception of a plurality of rounded knobs 230 that protrude from and extend the length of the biasing member 204.

The steering lock 208 includes a pair of protrusions 232, a base recess 234, and a circumferential ring recess 236. The pair of protrusions 232 work to trap the steering lock 208 within the recess created between the covers 212, 214. In this manner, the pair of protrusions 232 prevent the steering lock 208 from rotating about the vertical axis 48G of the steering mechanism 16G, absent force from a user. The ring recess 236 is adopted to allow the lock ring 206 to fit around the recess 236. The base recess 234 around the base of the steering lock 206 is adopted to receive and create an interference fit with a lock end 238 of the biasing member 204. Similar to the recess 224 of the lower lip 220, the width of the base recess 234 may vary around its circumference in order to accommodate reception of the plurality of rounded knobs 230 protruding from the biasing member 204, as shown in FIG. 17. A top end 240 of the hose 210 is secured to the steering lock 208 via a threaded connection 242 as illustrated in FIG. 18.

Figure 15:
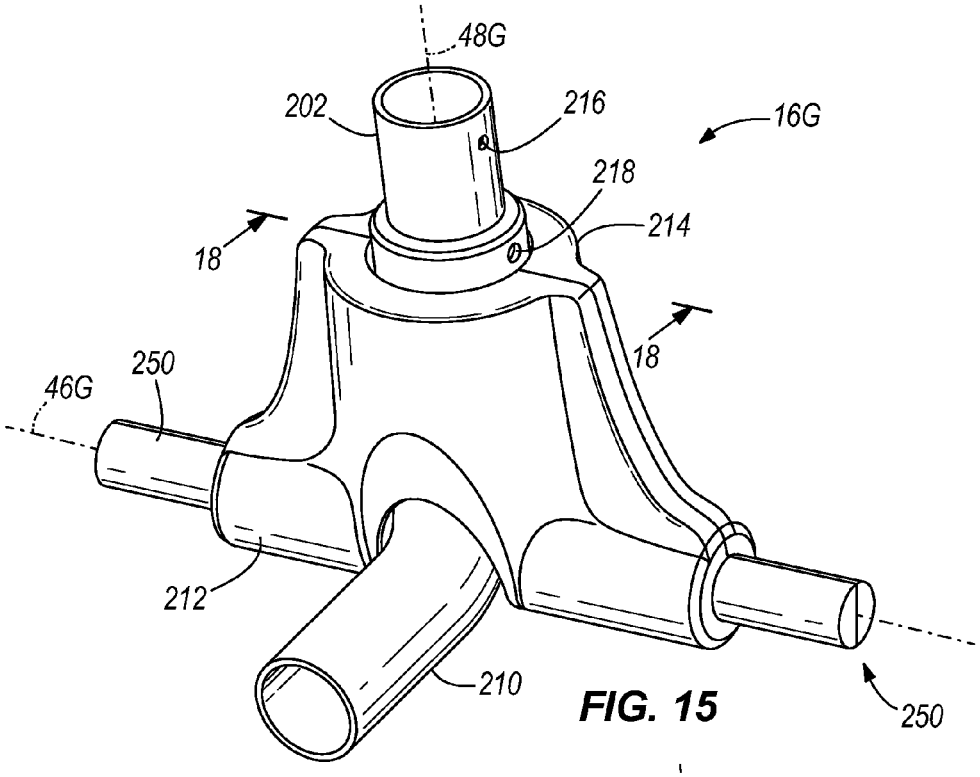
FIG. 15 is a perspective view of a steering assembly according to another embodiment of the invention.
Figure 16:
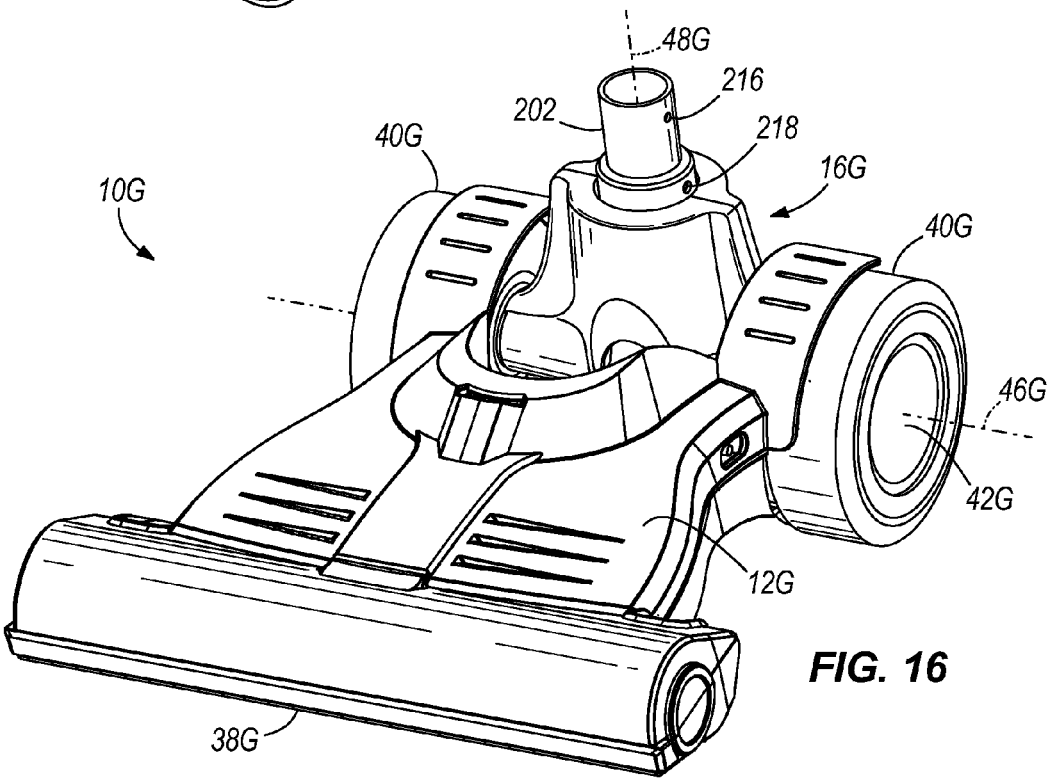
FIG. 16 is a perspective view of a foot of a surface cleaning device including the steering assembly of FIG. 15 coupled to the foot.

The covers 212, 214 have a pair of complementary half cylindrical extensions 244 (FIG. 17) that extend traverse to the axis 48G. When the covers 212, 214 are joined, the complementary extensions 244 together create rotatable cylinders 250 (FIG. 15). As shown in FIG. 16, a rotational axis 46G of the steering mechanism 16G, extending from rotatable cylinders 250, may be coincident with the axle 42G of the wheels 40G, similar to the horizontal axis 46 in FIG. 2A. In operation, the user pivots the handle assembly 18G about the axis 46G with respect to the foot 12G to an inclined position. Alternatively, and as described earlier and shown in FIG. 2B, the steering mechanism 16G and rotational axis 46G may be set forward of the axle 42G. The cylinders 250, when set within the foot 12G, work to allow a user to tilt the surface cleaning device 10G forward and backward about the axis 46G. In yet other embodiments, the steering mechanism 16G and axis 46G can be set rearward of the wheels 40G and axle 42G.

The biasing member 204 is an energy storing means that stores energy to facilitate steering the foot 12 of the vacuum. In the illustrated embodiment, the biasing member 204 is an elastic steering bushing, a single resilient piece of molded rubber having a durometer of about 90. In other embodiments, the biasing member 204 can be formed from other suitable materials having a different durometer. In yet other embodiments, the biasing member 204 can be any member or mechanism capable of storing energy, such as a compression spring, a torsion bar, a torsion fiber, a magnet, a pneumatic, or a hydraulic member. Whatever form the biasing member 204 takes, the biasing member 204 functions to store mechanical energy when the handle assembly 18G is twisted relative to the foot 12G. The stored energy is then used to bring the open path steering assembly 16G back to center after it has been rotated by a user by turning the foot 12G relative to the handle assembly 18G when the nozzle 12G is rolled forwards or backwards during use.

With continued reference to FIGS. 17 and 18, because the tube side 226 and the knobs 230 tightly fit within the recess 224 of the steering tube 202, the tube side 226 and the knobs 230 inhibit rotation of the tube end 226 of the biasing member 204 with respect to the steering tube 202. Similarly, because the lock end 238 and the knobs 230 tightly fit within the base recess 234 of the steering lock 208, the lock end 238 and the knobs 230 inhibit rotation of the lock end 238 of the biasing member 204 with respect to the steering lock 208. However, the biasing member 204 is resilient such that the ends 226, 238 of the biasing member 204, and therefore the steering tube 202 and the steering lock 208, can rotate with respect to each other about the axis 48G, and yet the biasing member 204 returns to its original position. Although the knobs 230 are rounded in the illustrated embodiment, in other embodiments, the knobs can take other suitable shapes. In yet other embodiments, adhesives, fasteners, and the like can be used to couple the ends 226 and 238 of the biasing member 204 for rotation with the respective steering tube 202 and the steering lock 208.

In operation, the user can steer the foot 12G to move the foot 12G generally in horizontal directions along the surface being cleaned. To steer the foot 12G, the user rotates the handle 14G, and therefore handle assembly 18G, with respect to the foot 12G about the axis 48G. When the user rotates the handle assembly 18G about the axis 48G, the steering tube 202, which is coupled for rotation with the handle 14G via the assembly aperture 216, rotates with respect to the steering lock 208, which is fixed from rotation about the axis 48G with respect to the foot 12G. Rotating the steering tube 202 with respect to the steering lock 208 causes the tube end 226 of the biasing member 204 to rotate with respect to the lock end 238 of the biasing member 204. The resilient properties of the biasing member 204 cause the biasing member 204 to resist rotation of the handle assembly 18G with respect to the foot 12G about the axis defined by the open path. However, this resistance and energy stored in the biasing member 204 by rotation of the handle 18G about the axis 48G, moves the foot 12G, depending on which direction the user rotates the handle assembly 18G about the axis defined by the open path. When the user no longer desires to turn the foot 12, the user releases or stops turning the handle 14G and handle assembly 18G about the axis 48G. Then, the handle assembly 18G rotates about the axis 48G back to its original position because of the resiliency and recovery forces of the biasing member 204.

The invention claimed is:

1. A surface cleaning device operable to clean a surface, the surface cleaning device comprising:

a foot;

a handle assembly including a user manipulated handle, the handle assembly being pivotally coupled to the foot about a first axis for movement between an upright position and an inclined position; and a steering assembly coupled to and defining an open path between the foot and the handle assembly, the steering assembly including a biasing member, wherein movement of the handle assembly about a second axis stores energy within the biasing member such that the biasing member exerts a corresponding force on the foot, and wherein the biasing member moves with the handle assembly relative to the foot when the handle assembly pivots between the upright position and the inclined position;

wherein the biasing member includes a resilient compressive member having a first portion rotationally fixed relative to the handle assembly and a second portion rotationally fixed relative to the foot, wherein movement of the handle assembly moves the first portion relative to the second portion to store energy between the first and second portions within the biasing member such that the biasing member exerts a corresponding force on the foot.

2. The surface cleaning device of claim 1, wherein the foot includes a suction opening.

3. The surface cleaning device of claim 2, wherein the surface cleaning device is an upright vacuum cleaner and wherein the handle assembly includes a dirt collection chamber and a motor housing, wherein the open path fluidly couples the suction opening and the dirt collection chamber.

4. The surface cleaning device of claim 2, wherein the surface cleaning device is a canister vacuum cleaner further comprising a canister housing having a dirt collection chamber and a motor housing, and wherein the handle assembly includes a handle and a tube extending between the handle and the foot, wherein the open path fluidly couples the suction opening and the dirt collection chamber.

5. The surface cleaning device of claim 2, wherein the surface cleaning device is a wet vacuum cleaner and wherein the handle assembly includes a liquid recovery chamber and a motor housing, wherein the open path fluidly couples the suction opening and the liquid recovery chamber.

6. The surface cleaning device of claim 1, wherein the foot includes a dispensing port.

7. The surface cleaning device of claim 6, wherein the handle assembly includes a clean liquid tank for carrying liquid and wherein the open path fluidly couples the clean liquid tank and the dispensing port, such that the dispensing port dispenses liquid from the clean liquid tank on the surface.

8. The surface cleaning device of claim 6, wherein the handle assembly includes a heating element that stores liquid, such that said heating element can heat the stored liquid to create steam, and wherein the open path fluidly couples the heating element and the dispensing port such that the dispensing port dispenses steam created by the heating element on the surface.

9. The surface cleaning device of claim 1, wherein the handle assembly includes a power source and wherein the steering assembly further includes at least one electrical element capable of carrying an electrical current, wherein the open path permits passage of the at least one electrical element from the power source to the foot, such that the power source can provide electrical power to the foot via the electrical element.

10. The surface cleaning device of claim 1, wherein the handle assembly includes a longitudinal axis, wherein the longitudinal axis is collinear with the second axis, and wherein rotation of the handle assembly about the longitudinal axis stores energy within the biasing member such that the biasing member exerts a corresponding force on the foot to encourage turning of the foot.

11. The surface cleaning device of claim 10, wherein the biasing member turns the foot when the foot is moved one of forward and backward.

12. The surface cleaning device of claim 1, wherein the foot includes a foot housing, front wheels rotatably coupled to a front portion of the foot housing, and rear wheels rotatably coupled to a rear portion of the foot housing.

13. The surface cleaning device of claim 1, wherein the resilient compressive member is a resilient compressive conduit.

14. The surface cleaning device of claim 1, wherein the biasing member wraps completely around the open path.

15. A surface cleaning device operable to clean a surface, the surface cleaning device comprising:

a foot;

a handle assembly including a user manipulated handle; and a steering assembly that pivotally couples and defines an open path between the handle assembly and the foot, the steering assembly including a first pivot member coupled to a lower portion of the handle assembly such that the first pivot member rotates with the handle assembly about a pivot axis, a second pivot member coupled to the foot such that the second pivot member rotates with the foot about the pivot axis, the first and second pivot members coupled to each other for relative rotation about the pivot axis, and a biasing member coupled to the first pivot member and the second pivot member to resist relative rotation between the first pivot member and the second pivot member about the pivot axis, wherein rotation of the handle assembly and the first pivot member about the pivot axis stores energy within the biasing member such that the biasing member exerts a corresponding force on the second pivot member and the foot to encourage turning of the foot;

wherein the open path is generally coaxial with the pivot axis; and wherein the biasing member exerts the corresponding force on the second pivot member and the foot when the first pivot member and the handle assembly are rotated in either direction about the pivot axis.

16. The surface cleaning device of claim 15, wherein the foot includes a suction opening.

17. The surface cleaning device of claim 16, wherein the surface cleaning device is an upright vacuum cleaner and wherein the handle assembly includes a dirt collection chamber and a motor housing, wherein the open path fluidly couples the suction opening and the dirt collection chamber.

18. The surface cleaning device of claim 16, wherein the surface cleaning device is a canister vacuum cleaner further comprising a canister housing having a dirt collection chamber and a motor housing, and wherein the handle assembly includes a handle and a tube extending between the handle and the foot, wherein the open path fluidly couples the suction opening and the dirt collection chamber.

19. The surface cleaning device of claim 16, wherein the surface cleaning device is a wet vacuum cleaner and wherein the handle assembly includes a liquid recovery chamber and a motor housing, wherein the open path fluidly couples the suction opening and the liquid recovery chamber.

20. The surface cleaning device of claim 15, wherein the foot includes a dispensing port.

21. The surface cleaning device of claim 20, wherein the handle assembly includes a clean liquid tank for carrying liquid and wherein the open path fluidly couples the clean liquid tank and the dispensing port, such that the dispensing port dispenses liquid from the clean liquid tank on the surface.

22. The surface cleaning device of claim 20, wherein the handle assembly includes a heating element that stores liquid, such that said heating element can heat the stored liquid to create steam, and wherein the open path fluidly couples the heating element and the dispensing port such that the dispensing port dispenses steam created by the heating element on the surface.

23. The surface cleaning device of claim 15, wherein the handle assembly includes a power source and wherein the steering assembly further includes at least one electrical element capable of carrying an electrical current, wherein the open path permits passage of the at least one electrical element from the power source to the foot, such that the power source can provide electrical power to the foot via the electrical element.

24. The surface cleaning device of claim 15, wherein the handle assembly includes a longitudinal axis, and wherein the longitudinal axis of the handle assembly is parallel to the pivot axis.

25. The surface cleaning device of claim 24, wherein the longitudinal axis and the pivot axis are collinear.

26. The surface cleaning device of claim 15, wherein the biasing member turns the foot when the foot is moved one of forward and backward.

27. The surface cleaning device of claim 15, wherein the foot includes a foot housing, front wheels rotatably coupled to a front portion of the foot housing, and rear wheels rotatably coupled to a rear portion of the foot housing.

28. The surface cleaning device of claim 15, wherein the handle assembly, first pivot member, biasing member, and second pivot member are pivotable as a unit relative to the foot about an incline axis that is perpendicular to the pivot axis.

29. The surface cleaning device of claim 28, wherein the incline axis is horizontal.

30. The surface cleaning device of claim 15, wherein the biasing member surrounds the open path.

* * * * *